US008083582B2

(12) United States Patent
Kato

(10) Patent No.: US 8,083,582 B2
(45) Date of Patent: Dec. 27, 2011

(54) GAMING MACHINE

(75) Inventor: Yoichi Kato, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 556 days.

(21) Appl. No.: 12/252,956

(22) Filed: Oct. 16, 2008

(65) Prior Publication Data

US 2009/0104973 A1 Apr. 23, 2009

(30) Foreign Application Priority Data

Oct. 19, 2007 (JP) ..... 2007-272859

(51) Int. Cl.
*A63F 9/24* (2006.01)

(52) U.S. Cl. ..... 463/20; 463/16; 463/25; 463/29

(58) Field of Classification Search ..... 463/16, 463/20, 25, 29, 42
See application file for complete search history.

(56) References Cited

U.S. PATENT DOCUMENTS

| | | | | |
|---|---|---|---|---|
| 6,517,433 | B2 | 2/2003 | Loose et al. | |
| 7,503,847 | B2 * | 3/2009 | Baerlocher | 463/20 |
| 2003/0211879 | A1 * | 11/2003 | Englman | 463/20 |
| 2004/0018874 | A1 * | 1/2004 | Bonney et al. | 463/25 |
| 2004/0147306 | A1 * | 7/2004 | Randall et al. | 463/20 |
| 2009/0186692 | A1 * | 7/2009 | Thomas et al. | 463/29 |
| 2010/0075746 | A1 * | 3/2010 | Anderson et al. | 463/25 |

* cited by examiner

*Primary Examiner* — Masud Ahmed
(74) *Attorney, Agent, or Firm* — NDQ&M Watchstone LLP

(57) ABSTRACT

When three or more feature symbols are stopped on the variable display portion, the slot machine provides a free game. In the bonus game process, the main CPU determines the number of game condition choice images to be displayed on the selection screen according to the number of feature symbols that have been stopped on the variable display portion. When one of the game condition choice images is selected from the game condition choice images displayed on the selection screen by the player, the main CPU executes the free game according to the free game execution condition associated with the selected game condition choice image.

4 Claims, 18 Drawing Sheets

FIG. 12

| | of a Kind | | | | | | | | | | | | |
|---|---|---|---|---|---|---|---|---|---|---|---|---|---|
| | 3 | 4 | 5 | 6 | 7 | 8 | 9 | 10 | 11 | 12 | 13 | 14 | 15 |
| TREASURE | 80 | 150 | 250 | 400 | 400 | 400 | 500 | 500 | 500 | 600 | 600 | 600 | 700 |
| WATERMELON | 70 | 120 | 200 | 350 | 350 | 350 | 400 | 400 | 400 | 500 | 500 | 500 | 600 |
| GRAPE | 60 | 100 | 180 | 300 | 300 | 300 | 350 | 350 | 350 | 400 | 400 | 400 | 500 |
| PLUM | 40 | 80 | 120 | 150 | 150 | 200 | 200 | — | — | — | — | — | — |
| ORANGE | 30 | 60 | 100 | 120 | 120 | 150 | 150 | — | — | — | — | — | — |
| A | 25 | 50 | 75 | — | — | — | — | — | — | — | — | — | — |
| K | 20 | 40 | 60 | — | — | — | — | — | — | — | — | — | — |
| Q | 15 | 30 | 45 | — | — | — | — | — | — | — | — | — | — |
| J | 10 | 20 | 30 | — | — | — | — | — | — | — | — | — | — |
| 10 | 8 | 15 | 25 | — | — | — | — | — | — | — | — | — | — |
| 9 | 5 | 10 | 15 | — | — | — | — | — | — | — | — | — | — |

FIG. 15

| REEL BAND | |
|---|---|
| CODE NUMBER | SYMBOL |
| 00 | GRAPE |
| 01 | Q |
| 02 | 9 |
| 03 | ORANGE |
| 04 | K |
| 05 | WATERMELON |
| 06 | TREASURE |
| 07 | GRAPE |
| 08 | 10 |
| 09 | FEATURE |
| 10 | J |
| 11 | MULTI-A |
| 12 | PLUM |
| 13 | 10 |
| 14 | 9 |
| 15 | MULTI-PLUM |
| 16 | A |
| 17 | J |
| 18 | TREASURE |
| 19 | MULTI-K |
| 20 | 10 |
| ⋮ | ⋮ |

FIG. 16

| RANDOM NUMBER VALUE | CODE NUMBER |
|---|---|
| 0~127 | 00 |
| 128~255 | 01 |
| 256~383 | 02 |
| 384~511 | 03 |
| 512~760 | 04 |
| 761~767 | 05 |
| 768~895 | 06 |
| 896~1023 | 07 |
| 1024~1151 | 08 |
| 1152~1279 | 09 |
| 1280~1307 | 10 |
| 1308~1335 | 11 |
| 1336~1364 | 12 |
| 1365~1491 | 13 |
| 1492~1919 | 14 |
| 1920~2047 | 15 |
| 2048~2175 | 16 |
| 2176~2303 | 17 |
| 2304~2431 | 18 |
| 2432~2559 | 19 |
| 2560~2687 | 20 |
| ⋮ | ⋮ |

| NUMBER OF FEATURE SYMBOLS DISPLAYED | NUMBER OF CHOICES |
|---|---|
| 3 | 8 |
| 4~6 | 16 |
| 6~ | 24 |

FIG. 23

| GAME CONDITION CHOICES (NUMBER OF FREE GAMES) | RANDOM NUMBER VALUE |
|---|---|
| 2GAMES | 0~20 |
| 3GAMES | 21~41 |
| 4GAMES | 42~63 |
| 5GAMES | 64~84 |
| 6GAMES | 85~105 |
| 7GAMES | 106~127 |
| 8GAMES | 128~148 |
| 9GAMES | 149~169 |
| 10GAMES | 170~191 |
| 11GAMES | 192~212 |
| 12GAMES | 213~233 |
| 13GAMES | 234~255 |
| 14GAMES | 256~276 |
| 15GAMES | 277~297 |
| 16GAMES | 298~319 |
| 17GAMES | 320~340 |
| 18GAMES | 341~361 |
| 19GAMES | 362~383 |
| 20GAMES | 384~404 |
| 21GAMES | 405~425 |
| 22GAMES | 426~447 |
| 23GAMES | 448~468 |
| 24GAMES | 469~489 |
| 25GAMES | 490~511 |

GAMING MACHINE

CROSS-REFERENCE TO RELATED APPLICATIONS

This application is based upon and claims a priority from the prior Japanese Patent Application No. 2007-272859 filed on Oct. 19, 2007, the entire contents of which are incorporated herein by reference.

BACKGROUND

1. Field

The present invention relates to a gaming machine that awards a prize based on a result of a base game in which symbols are variably displayed and stopped. In particular, the present invention relates to a gaming machine which may execute a bonus game in a case where a result of a base game corresponds to one of plural types of special combinations.

2. Description of Related Art

Conventionally, there has been known a gaming machine that is provided with a symbol display portion including a plurality of symbol display areas. The gaming machine executes a bonus game in a case where predetermined conditions are satisfied (for example, the gaming machine disclosed in U.S. Pat. No. 6,517,433).

The predetermined conditions include whether a combination of symbols stopped on the symbol display areas that constitute an effective pay line corresponds to a predetermined combination or whether the number of specific symbols stopped on the symbol display areas that constitute the symbol display portion is equal to or more than a predetermined number.

For example, the gaming machine disclosed in the U.S. Pat. No 6,517,433 executes a bonus game in a case where a specific symbol or a specific symbol combination appears on a pay line on which a game value is bet (that is, effective pay line).

Here, the conventional gaming machine described above always awards the same special prize in a case where predetermined conditions are satisfied. For example, the gaming machine disclosed in the U.S. Pat. No. 6,517,433 provides a bonus game at the time point that a specific symbol combination appears on the effective pay line. In addition, the contents of the provided bonus game are always the same as long as the conditions are satisfied.

The conventional gaming machines may be configured to provide a bonus game if one of plural types of conditions is satisfied. In this case, the conditions for providing the bonus game are plural, and therefore, probability of achieving each condition becomes different. In this case, a player who satisfies a condition whose satisfying probability is low will feel a large feeling of accomplishment in satisfying such a condition. In addition, the player also has a large feeling of expectancy in the following bonus games.

However, in this case, the conventional gaming machine still provides the same bonus game to the player. Accordingly, the conventional gaming machine may damage to the player's feeling of expectancy for the bonus game, thus leading to lowering in interest. In this case, the same bonus game is also provided to another player who satisfies a condition whose achieving probability is high. As a result, the gaming machine may cause the former player who satisfies the condition whose achieving condition is low to have a feeling of inequity.

The present invention has been designed considering the above problems, and the present invention relates to a gaming machine that may execute a bonus game in a case where a result of a base game corresponds to one of plural types of conditions. An object of the present invention is to provide a gaming machine that may raise interest without damaging to a feeling of expectancy of a player coming from the presence of plural types of conditions.

SUMMARY

Therefore, in order to achieve the object, according to a first aspect of the present invention, there is provided a gaming machine comprising: a display on which plural types of symbols are variably displayed and stopped; and a process for executing, (a) a process of executing a base game, wherein the symbols start to be variably displayed on the display and the symbols are stopped while the symbols are variably displayed on the display; (b) a process of awarding a prize for the base game based on a combination of the symbols stopped on the display; (c) a process of determining the number of choice images each of which a bonus game condition is related, the choice images being selectable by a player and displayed on the display, according to the corresponding type of the special combination, in a case where the combination of the symbols stopped on the display corresponds to one of plural types of special combinations; and (d) a process of displaying the determined number of the choice images on the display, accepting a selection of the player for the choice images, and executing the bonus game according to the bonus game condition related to the choice image selected by the player.

This gaming machine executes a base game. The gaming machine awards a prize of the base game based on a combination of symbols stopped on a display.

In a case where the combination of the symbols stopped on the display as a result of the base game corresponds to one of plural types of special combinations, the gaming machine determines the number of choice images to be displayed on the display according to the corresponding type of special combination. That is, the gaming machine changes the number of selectable choice images (that is, degree of freedom in selection) according to the corresponding type of special combination. That is, the gaming machine may alleviate a feeling of inequity between players by changing the number of the selectable choice images.

In addition, the gaming machine executes a bonus game according to a condition concerning the bonus game associated with the selected choice image.

The gaming machine executes the bonus game under a desired condition based on the player's selection. Accordingly, the gaming machine does not damage player's feeling of expectancy for the bonus game. Moreover, the gaming machine may raise interest in the bonus game.

According to one or more aspects of the present invention, there is provided a gaming machine comprising: a display on which plural types of symbols are variably displayed and stopped; and a processor for executing, (a) a process of executing a base game, wherein the symbols start to be variably displayed on the display and the symbols are stopped while the symbols are variably displayed on the display; (b) a process of awarding a prize for the base game based on a combination of the symbols stopped on the display; (c) a process of determining the number of choice images that are selectable by a player and displayed on the display, according to the type of the special combination, in a case where the combination of the symbols stopped on the display corresponds to one of plural types of special combinations; (d) a process of determining the determined number of choice images to be displayed on the display by lottery out of plural choice images each of which a different bonus game condition is related to; and (e) a process of displaying the determined choice images on the display, accepting a selection of the player for the choice images, and executing a bonus game according to the bonus game condition related to the choice image selected by the player.

Like the above-mentioned gaming machine, in a case where the result of a base game corresponds to one of plural types of special combinations, this gaming machine determines the number of choice images to be displayed on the display according to the corresponding type of special combination. That is, the gaming machine may alleviate a feeling of inequity between players by changing the number of selectable choice images.

In addition, the gaming machine determines by lottery a plural number (that is, a certain number corresponding to the type of the special combination) of choice images to be displayed on the display from the plural choice images to each of which a different bonus game condition is related. Accordingly, the gaming machine may diversify the conditions of the bonus game selectable by a player. As a result, the gaming machine may provide the player with bonus games under a diversity of conditions. Thus, the gaming machine may prevent the bonus game from being monotonous.

Moreover, the gaming machine may provide a strategy properties in selecting a condition concerning a bonus game. Accordingly, the gaming machine may provide a new zest in selecting the choice image.

In addition, the gaming machine executes the bonus game according to a condition concerning the bonus game associated with the selected choice image. By doing so, a player may execute a bonus game based on his desired condition. As a result, the gaming machine does not damage player's feeling of expectancy for the bonus game. Moreover, the gaming machine may raise interest in the bonus game.

According to one or more aspects of the present invention, there is provided a gaming machine comprising: a display on which plural types of symbols including special symbols are variably displayed and stopped; and a process for executing, (a) a process of executing a base game, wherein the symbols start to be variably displayed on the display and the symbols are stopped while the symbols are variably displayed on the display; (b) a process of awarding a prize for the base game based on the number of symbols of a same type that are stopped on the display; (c) a process of, if at least a predetermined number of special symbols is stopped on the display, changing the number of choice images to be displayed on the display, the number of choice images selectable by a player, based on the number of special symbols stopped on the display, and determining the number of choice images to be displayed on the display; (d) a process of determining the determined number of choice images to be displayed on the display by lottery out of plural choice images each of which a different bonus game condition is related to; and (e) a process of displaying the determined choice images on the display, accepting a selection of the player for the choice images, and executing a bonus game according to the bonus game condition related to the choice image selected by the player.

In a case where special symbols of more than a predetermined number are stopped on the display, this gaming machine determines the number of choice images to be displayed on the display according to the number of special symbols stopped. That is, the gaming machine changes the number of choice images that are selectable by a player and displayed on the display. By doing so, the gaming machine may alleviate a feeling of inequity between players by changing the number of selectable choice images.

In addition, the gaming machine determines by lottery plural choice images to be displayed on the display from the plural choice images to each of which a different bonus game condition is related. Accordingly, the gaming machine may diversify the conditions of the bonus game selectable by a player. As a result, the gaming machine may prevent the bonus game from being monotonous. Further, the gaming machine may provide a strategy properties in selecting a condition concerning a bonus game and therefore raise interest.

Moreover, the gaming machine executes a bonus game according to a condition concerning the bonus game associated with a selected choice image. This allows a player to execute a bonus game based on his desired condition. As a result, the gaming machine does not damage the player's feeling of expectancy about the bonus game. In addition, the gaming machine may raise interest in the bonus game.

BRIEF DESCRIPTION OF THE DRAWINGS

FIG. 12 is an explanatory view illustrating a payout table of the slot machine;

FIG. 15 is an explanatory view illustrating a table associating code numbers and symbols in the slot machine;

FIG. 16 is an explanatory view illustrating a table associating random number values and code numbers in the slot machine;

FIG. 23 is an explanatory view of a to-be-displayed choice lottery table.

DETAILED DESCRIPTION

The various aspects summarized previously may be embodied in various forms. The following description shows by way of illustration of various combinations and configurations in which the aspects may be practiced. It is understood that the described aspects and/or embodiments are merely examples, and that other aspects and/or embodiments may be utilized and structural and functional modifications may be made, without departing from the scope of the present disclosure.

It is noted that various connections are set forth between items in the following description. It is noted that these connections in general and, unless specified otherwise, may be direct or indirect and that this specification is not intended to be limiting in this respect.

A gaming machine according to one or more aspects of the invention will be described in detail with reference to the drawings based on an embodiment embodying one or more aspects of the invention. However, it is appreciated that one or more aspects of the present invention may be embodied in distributable (via CD and the like) or downloadable software games, console games, and the like. In this regard, the slot machine may be a virtual slot machine that is displayed on a multi-purpose computer and/or dedicated kiosk. Aspects of the invention are described by way of hardware elements. However, it is appreciated that these elements may also be software modules that are executable in a computer. The software modules may be stored on a computer readable medium, including but not limited to a USB drive, CD, DVD, computer-readable memory, tape, diskette, floppy disk, and the like. For instance, aspects of the invention may be embodied in a JAVA-based application or the like that runs in a processor or processors. Further, the terms "CPU", "processor", and "controller" are inclusive by nature, including at least one of hardware, software, or firmware. These terms may include a portion of a processing unit in a computer (for instance, in multiple core processing units), multiple cores, a functional processor (as running virtually on at least one of processor or server, which may be local or remote). Further, in network-based gaming systems, the processor may include only a local processor, only a remote server, or a combination of a local processor and a remote server.

It is contemplated that one or more aspects of the invention may be implemented as computer executable instructions on a computer readable medium such as a non-volatile memory, a magnetic or optical disc. Further, one or more aspects of the invention may be implemented with a carrier signal in the form of, for instance, an audio-frequency, radio-frequency, or optical carrier wave.

Hereinafter, a embodiment where a gaming machine according to the present invention is applied to a slot machine 1 will be described below with reference to the accompanying drawings.

Figure 2:
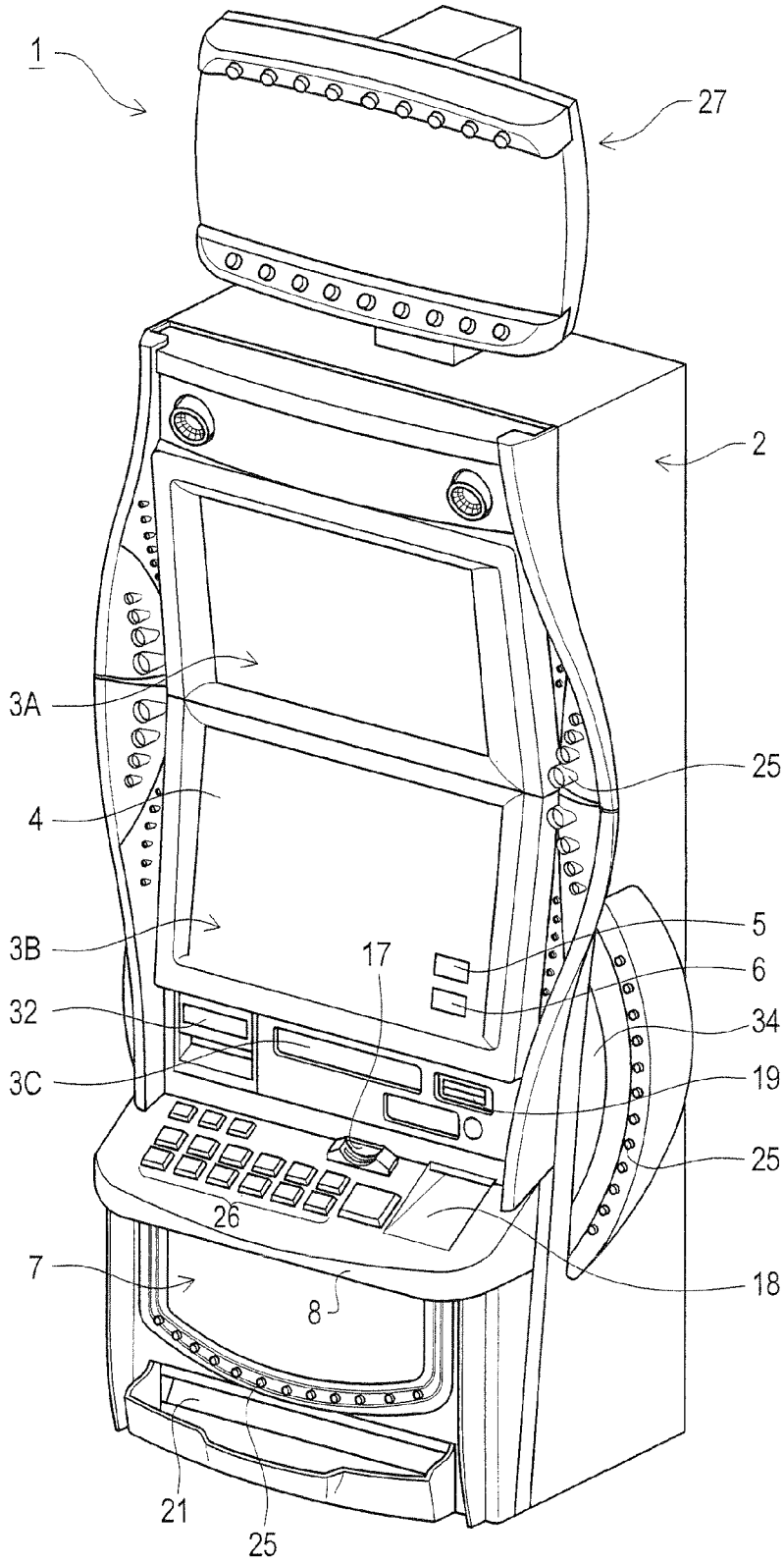
FIG. 2 is a perspective view of a slot machine.

As shown in FIG. 2, the slot machine 1 according to the present embodiment includes an image display device such as a liquid crystal display. In addition, the slot machine 1 executes a game by displaying images of various symbols on the image display device. That is, the slot machine 1 is a so-called video slot machine.

The slot machine 1 according to the present embodiment variably displays and stops twelve types of normal symbols such as a feature symbol 45A through an ace symbol 45L and eleven types of multi symbols 50 (that is, a multi treasure box symbol 50B through a multi ace symbol 50L) on a variable display portion 3B. The slot machine 1 awards a player a prize that is determined according to the number of same types of symbols stopped on the variable display portion 3B.

Here, in a case where three or more feature symbols 45A are stopped on the variable display portion 3B, and a bonus game trigger is achieved (S19: YES), the slot machine 1 provides the player with a so-called free game as a bonus game (S20). The free game means a game that can be executed without the player betting a new credit.

In the bonus game process (S20), before the initiation of the bonus game, the slot machine 1 displays a selection screen (refer to FIG. 19 through FIG. 21) on the variable display portion 3B. A plurality of game condition choice images 90 are displayed on the selection screen. The number of game condition choice images 90 displayed on the selection screen is determined according to the number of feature symbols 45A that have been stopped on the previous variable display portion 3B. Further, the plural game condition choice images 90 to be displayed on the selection screen are determined from the plurality of game condition choice images 90 by lottery. Each of the game condition images 90 is related to a different free game condition (for example, the number of free games, a payout rate, etc.).

Further, the slot machine 1 accepts a selection of the player for the plurality of game condition choice images 90. The slot machine 1 executes the free game as a bonus game based on the free game execution condition associated with the selected game condition choice image.

In a case where three or more feature symbols 45A are stopped on the variable display portion 3B, the slot machine 1 changes the number of game condition choice images 90 to be displayed on the selection screen (refer to FIG. 19 through FIG. 21) according to the number of feature symbols 45A stopped on the variable display portion 3B. As a result, the number of game condition choice images 90 that may be selected by the player (that is, degree of freedom in free game condition) is changed. Accordingly, the slot machine 1 may alleviate a feeling of inequity between players.

In addition, the slot machine 1 executes the free game according to the free game execution conditions (that is, the number of free games or pay out rate and the like) associated with the game condition choice images 90 selected by the player. That is, the slot machine 1 executes the free game based on the desired execution conditions that selected by the player. Accordingly, the slot machine 1 does not damage the player's feeling of expectancy about the free game. Furthermore, the slot machine 1 may raise interest in the free game.

The game condition choice images 90 to be displayed on the selection screen are determined from the plurality of game condition images 90 by lottery. As a result, the slot machine 1 may diversify the free game execution conditions that can be selected by the player. Accordingly, the slot machine 1 may provide the player with the free game under a diversity of conditions. This may enable the slot machine 1 to prevent the free game from being monotonous. In addition, the player may arbitrarily select any one of the game condition choice images 90 displayed on the selection screen. Herewith, the slot machine 1 may provide the player with the interest of "strategy properties concerning the selection of the game condition choice image 90".

Next, a schematic construction of the slot machine 1 according to the present embodiment will be described with reference to accompanying drawings. FIG. 2 is a perspective view illustrating the slot machine 1 according to the present embodiment. The slot machine 1 according to the present embodiment is an upright type slot machine that is installed in a game arcade such as a casino or the like. It should be noted that the slot machine 1 shown in FIG. 2 is merely an example of the slot machine according to the present embodiment, and is not limited thereto.

As shown in FIG. 2, the slot machine 1 includes a cabinet 2. The cabinet 2 serves as housing portion for housing electrical or mechanical components. These electrical or mechanical components are used in execution of a predetermined game aspect.

Further, the slot machine 1 includes an upper display portion 3A, a variable display portion 3B, and a lower display portion 3C on the front of the cabinet 2. The upper display portion 3A, the variable display portion 3B and the lower display portion 3C display various types of game information.

The upper display portion 3A is constituted a liquid crystal panel. The upper display portion 3A is arranged at the upper portion of the cabinet 2. The upper display portion 3A displays an effect image, a payout table during a game, a game rule, and the like.

Figure 3:
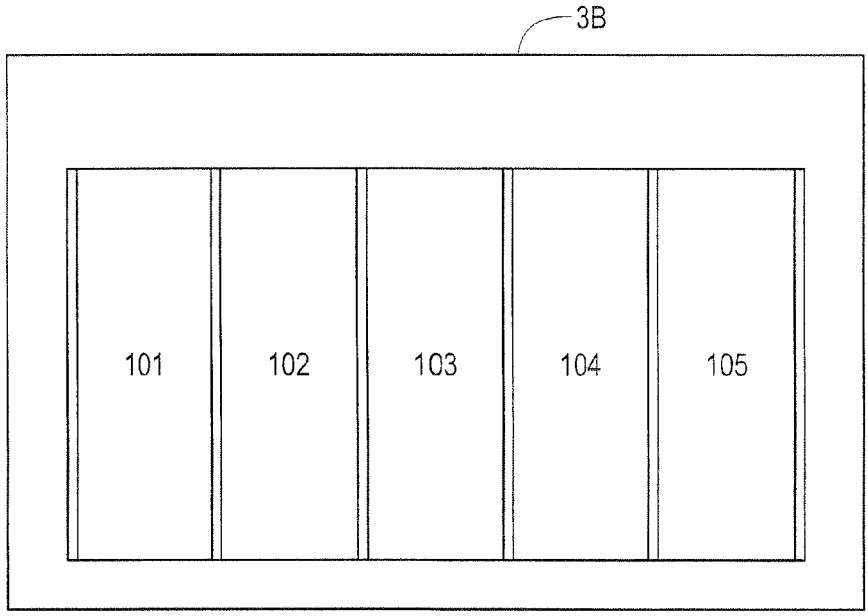
FIG. 3 is an explanatory view illustrating reel display portions of the slot machine.
Figure 4:
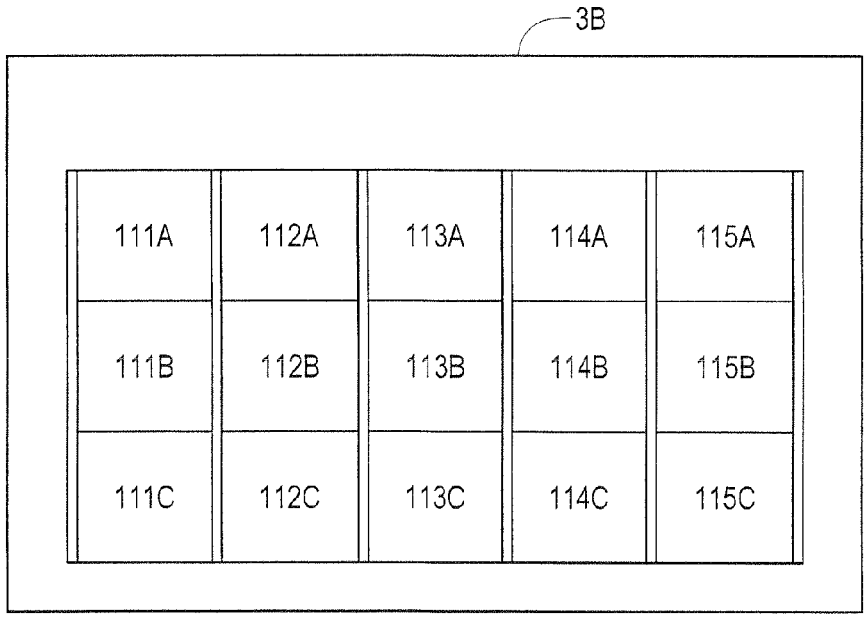
FIG. 4 is an explanatory view illustrating a reel display portion of the slot machine.

The variable display portion 3B is constituted a liquid crystal panel. The variable display portion 3B is arranged at the middle portion of the cabinet 2. The variable display portion 3B includes five reel display portions 101 through 105 in the form of a column (refer to FIG. 3). A symbol column is variably displayed and stopped on each of the reel display portions. Each of the reel display portions 101 through 105 has three symbol display areas. More specifically, each of the reel display portions 101 through 105 has symbol display areas 111A through 111C, symbol display areas 112A through 112C, symbol display areas 113A through 113C, symbol display areas 114A through 114C, and symbol display areas 115A through 115C, respectively. Each of the symbol display areas displays one symbol (refer to FIG. 4). That is, the variable display portion 3B displays fifteen symbols in the form of a 3×5 matrix. In the meantime, the number of reels and the number of symbols displayed on one reel display portion may vary.

A touch panel 4 is provided on the front of the liquid crystal panel of the variable display portion 3B. A player can enter various instructions by operating the touch panel 4. In addition, a payout amount display portion 5 and a credit amount display portion 6 are located at the lower right portion of the variable display portion 3B. The display position to arrange the payout amount display portion 5 and the credit amount display portion 6 can be determined arbitrarily. Furthermore, a bet-number display portion for displaying the number of bets may be provided at the variable display portion 3B. The payout amount display portion 5 displays the payout amount awarded to the player (that is, the payout amount awarded by meeting a predetermined condition at a base game, and the accumulated payout amount acquired during a free game). The credit amount display portion 6 displays the credit amount that the player currently possesses.

The lower display portion 3C is constituted a liquid crystal panel. The lower display portion 3C is arranged at the lower portion of the cabinet 2. The lower display portion 3C displays points recorded in a card or points of a game. In a case where a card is not inserted or the reading of card fails, the lower display portion 3C displays the fact that the card is not inserted or the reading of the card fails.

In addition, a card reading portion 19 is arranged near the lower display portion 3C. The card reading portion 19 reads out information recorded in the card that the player possesses.

As was described above, in the present embodiment, the upper display portion 3A, the variable display portion 3B and the lower display portion 3C are not limited to a liquid crystal display configuration. For example, each of the display portions may be composed of a CRT display, a plasma display, an LED display, or other known display device.

A lower panel 7 is arranged under the lower display portion 3C. The lower panel 7 is composed of a plastic panel on which graphics of characters relevant to the slot machine 1, the name of the slot machine 1, and the like are drawn. The lower panel 7 is illuminated by a backlight. The lower panel 7 may be composed of a liquid crystal display, a CRT display, a plasma display, an LED display, or other known display devices.

An operation table 8 is arranged under the variable display portion 3B. The operation table 8 has various types of operation buttons 26 (for example, an exchange button, a payout button, a help button, a bet button, a start button, and the like). In addition, a coin insertion portion 17 and a bill insertion portion 18 are disposed on the operation table 8.

The position to arrange the respective types of operation buttons can be determined arbitrarily. As necessary, one portion of the respective operation buttons may be eliminated or buttons may be newly added or replaced.

A coin payout portion and a coin tray 21 are formed at the lower portion of the cabinet 2. The coin payout portion serves to payout coins when the exchange button or the cash out button is operated. The coin tray 21 serves to receive the coins that were paid out from the coin payout portion. A coin detecting portion is disposed in the coin payout port. The coin payout portion has a coin detecting portion provided therein. The coin detecting portion is constituted of a sensor or the like. The coin detecting portion is adapted to detect the number of coins to be paid out from the coin payout portion.

In addition, light emitting portions 25 are provided around the cabinet 2 of the slot machine 1. When a player wins a prize or plays a bonus game, the light emitting portions 25 light in a predetermined lighting style. Further, a speaker 34 for audio output is provided on the side face of the cabinet 2. The position to arrange the light emitting portion 25 and the speaker 34 can be determined arbitrarily.

As shown in FIG. 2, the slot machine 1 has a topper effect device 27 at the upper portion of the cabinet 2. The topper effect device 27 has the shape of a rectangular board. Further, the topper effect device 27 is disposed substantially parallel to the upper display portion 3A. The topper effect device 27 displays various types of information. The shape of the topper effect device 27 can be designed arbitrarily.

Figure 5:
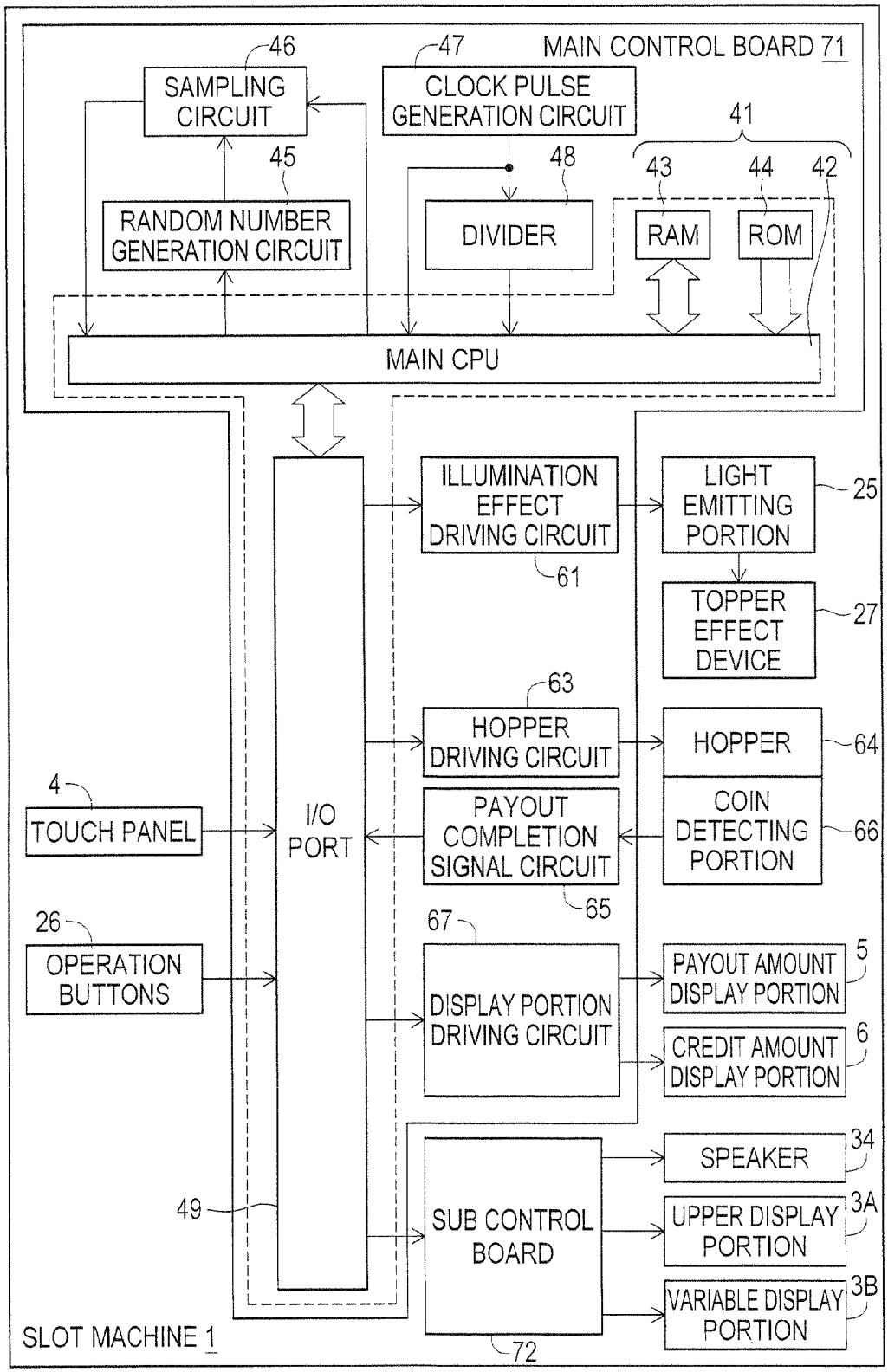
FIG. 5 is a block diagram illustrating an internal constitution of the slot machine.

Next, an internal construction of the slot machine 1 will be described with reference to accompanying drawings. FIG. 5 is a block diagram illustrating the entire internal construction of the entire slot machine 1. As shown in FIG. 5, the slot machine 1 has a main control board 71 including a controller 41, as a functional core. Further, the slot machine 1 has a plurality of components. The main control board 71 includes the controller 41, a random number generation circuit 45, a sampling circuit 46, a clock pulse generation circuit 47, a divider 48, an illumination effect driving circuit 61, a hopper driving circuit 63, a payout completion signal circuit 65, and a display portion driving circuit 67.

The controller 41 includes a main CPU 42, a RAM 43, and a ROM 44. The main CPU 42 is operated according to a program stored in the ROM 44, and performs signal input and output with respect to the other components through the I/O port 49. Accordingly, the main CPU 42 controls the operation of the entire slot machine 1. The RAM 43 stores data or programs to be used during the operation of the main CPU 42. For example, the RAM 43 temporarily stores a random number value which is sampled by the sampling circuit 46, after the beginning of a game. Further, the RAM 43 stores code numbers corresponding to the reel display portions 101 through 105. The ROM 44 stores various control programs executed by the main CPU 42, and permanent data.

The programs stored in the ROM 44 include game programs and game system programs (hereinafter, referred to as game programs). In addition, the game programs include lottery programs.

The lottery programs are executed upon determining the code numbers corresponding to symbols which are stopped at a central position in the respective reel display portions (specifically, symbol display areas 111B, 112B, 113B, 114B and 115B) of the variable display portion 3B.

Further, the lottery programs include symbol weighting data. The symbol weighting data shows a correspondence relationship between the code number and one or more random number values which belong to a predetermined numerical range (for example, 0 through 255). The probability of lottery with respect to each symbol on the reel band is set by associating one or a plurality of random number values to one code number. Further, the random number value is extracted by lottery, so that a symbol finally identified by the random number value is displayed on a predetermined area of the variable display portion 3B.

The random number generation circuit 45 is operated according to a command of the main CPU 42, and thus generates random numbers in a predetermined range. The sampling circuit 46 extracts arbitrary random numbers from the random numbers generated by the random number generation circuit 45, in accordance with the command of the main CPU 42. Then, the sampling circuit 46 inputs the extracted random numbers to the main CPU 42. The clock pulse generation circuit 47 generates a reference clock that is used to operate the main CPU 42. Furthermore, the divider 48 inputs the signals obtained by dividing the reference clock at a predetermined length of cycle to the main CPU 42.

In addition, the touch panel 4 is connected to the main control board 71. As described above, the touch panel 4 is disposed on the front of the variable display portion 3B. The touch panel 4 identifies coordinate position of a portion that was touched by the player. The touch panel 4 can determine the operation of the player (for example, where a player touches and which direction a touched portion is moved in) based on the coordinate position thus identified. Further, a signal in accordance with the determination result is input to the main CPU 42 through the I/O port 49. Accordingly, the touch panel 4 is used to select the game condition choice images 90 when the selection screen (refer to FIG. 19 through FIG. 21) is displayed on the variable display portion 3B.

Further, the operation buttons 26 (the above-mentioned start button and the like), which are used to command the executing of a game, are connected to the main control board 71 through operation switches. Accordingly, a signal in accordance with a depression operation of the operation buttons 26 is input to the main CPU 42 through the I/O port 49.

The illumination effect driving circuit 61 executes an illumination effect on the light emitting portions 25 and the topper effect device 27 by outputting an effect signal according to the command of the main CPU 42. Further, the topper effect device 27 is connected to the illumination effect driving circuit 61 through the light emitting portions 25.

The hopper driving circuit 63 drives a hopper 64 according to the control of the main CPU 42. Accordingly, the hopper 64 executes a predetermined operation, and pays out coins to the coin payout portion. Furthermore, the coin detecting portion 24 detects the number of coins that were paid out by the hopper 64. The coin detecting portion 24 inputs coin amount value data showing the amount of coins that was detected to the payout completion signal circuit 65. The payout completion signal circuit 65 receives the coin amount value data from the coin detecting portion 24. If the received coin amount value reaches the set number, the payout completion signal circuit 65 inputs a signal that notifies the completion of the payout of the coins to the main CPU 42. Further, the display portion driving circuit 67 controls the display operations of various display portions including the payout amount display portion 5 and the credit amount display portion 6 and the like.

Figure 6:
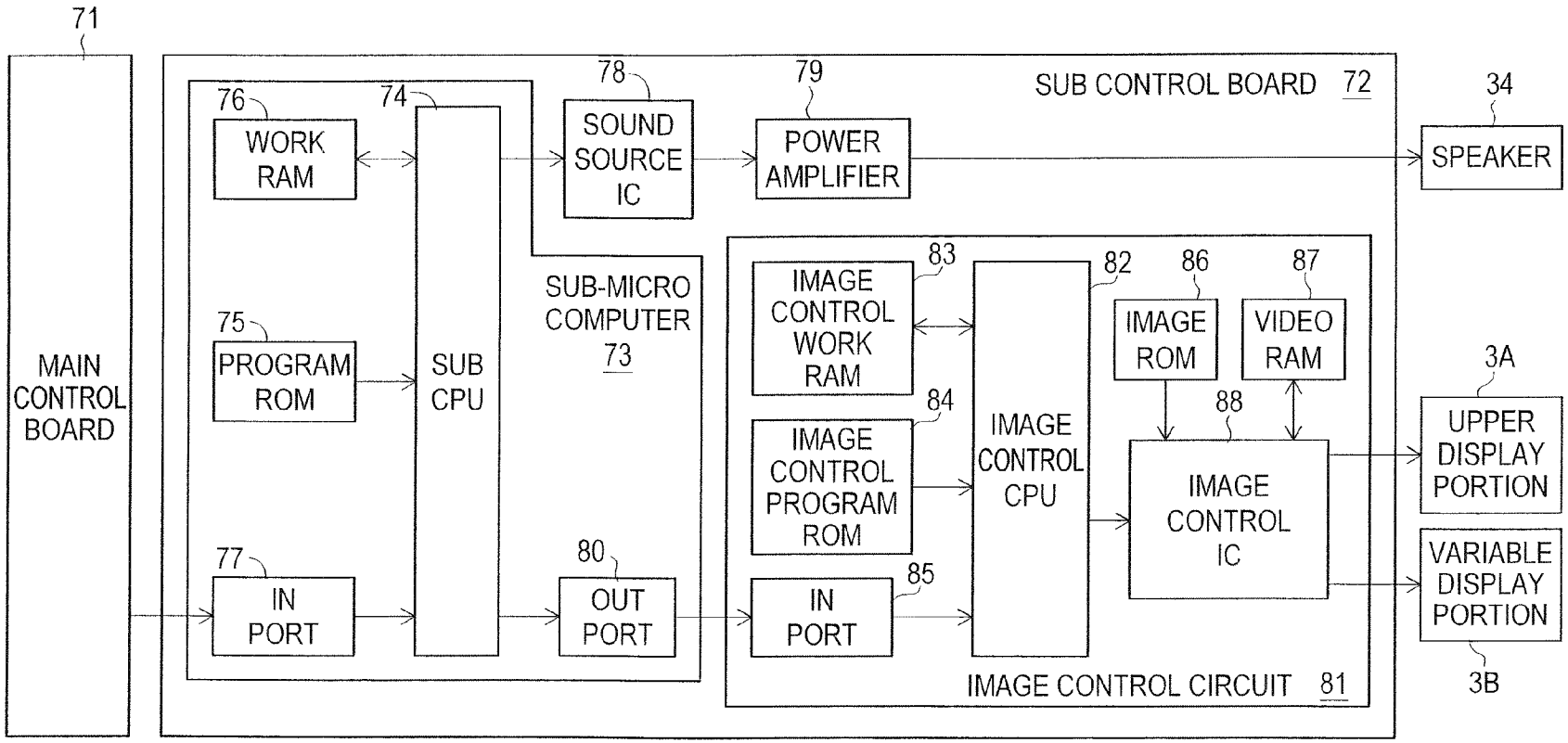
FIG. 6 is a block diagram illustrating an internal constitution of the sub control board of the slot machine.

Furthermore, a sub control board 72 is connected to the main control board 71. As shown in FIG. 6, the sub control board 72 controls the display of each display portion and the audio output from the speaker 34 based on the command input from the main control board 71. The sub control board 72 is formed on a circuit board that is separately formed from a circuit board forming the main control board 71. The sub control board 72 includes a micro computer (hereinafter, referred to as a "sub-micro computer 73") as a main component. Further, the sub control board 72 includes a sound source IC 78, a power amplifier 79, and an image control circuit 81. Meanwhile, the sound source IC 78 controls the audio output from the speaker 34. The power amplifier 79 functions as an amplifier with respect to the audio output from the speaker 34. Further, the image control circuit 81 functions as a display control device of the upper display portion 3A and the variable display portion 3B.

The sub-micro computer 73 includes a sub CPU 74, a program ROM 75, a work RAM 76, and I/O ports 77 and 80. The sub CPU 74 executes a control operation according to the control command received from the main control board 71. The program ROM 75 stores control programs executed in the sub CPU 74. The work RAM 76 is composed of a temporary memory to be used when the control programs are executed in the sub CPU 74. Meanwhile, the sub control board 72 does not include a clock pulse generation circuit, a divider, a random number generator, and a sampling circuit. In this regard, the sub control board 72 executes random number sampling based on an operation program of the sub CPU 74.

The image control circuit 81 has an image control CPU 82, an image control work RAM 83, an image control program ROM 84, an image ROM 86, a video RAM 87, and an image control IC 88. The image control CPU 82 determines images to be displayed on the upper display portion 3A and the variable display portion 3B based on the parameters set in the sub-micro computer 73 and image control programs to be described later.

For example, the image control CPU 82 displays a payout table or a help image on the upper display portion 3A. Further, the image control CPU 82 variably displays and stops a symbol on each of the symbol display areas 111A through 111C, 112A through 112C, 113A through 113C, 114A through 114C and 115A through 115C in the variable display portion 3B. Furthermore, in the bonus game process (S20), the image control CPU 82 displays the selection screen (refer to FIG. 19 to FIG. 21) including a plurality of game condition choice images 90 on the variable display portion 3B.

The image control program ROM 84 stores various selection tables and image control programs related to the display of the upper display portion 3A and the variable display portion 3B. The image control work RAM 83 functions as a temporary memory when the image control programs are executed in the image control CPU 82.

Further, the image control IC 88 forms images corresponding to the contents determined by the image control CPU 82. The image control IC 88 outputs the formed images to the upper display portion 3A and the variable display portion 3B. The image ROM 86 stores dot data for forming the images. The video RAM 87 functions as a temporary memory when images are formed in the image control IC 88.

Meanwhile, the internal constitution of the above-mentioned slot machine 1 is merely one example. Then, the present invention is not limited to the above-described constitution. For example, the memory card or the PLD (programmable logic device) may be constituted so as to be detachable. In this case, the slot machine may be formed so that necessary information may be read out from the memory card or the PLD.

Furthermore, the slot machine 1 related to the present invention employs coins, bills, or electronic valuable information (credit) corresponding to the coins or the bills, as gaming values. However, the gaming value which can be applied to the present invention is not limited thereto. For example, the slot machine may be formed to be capable of using medals, tokens, electronic money, and tickets.

Figure 7:
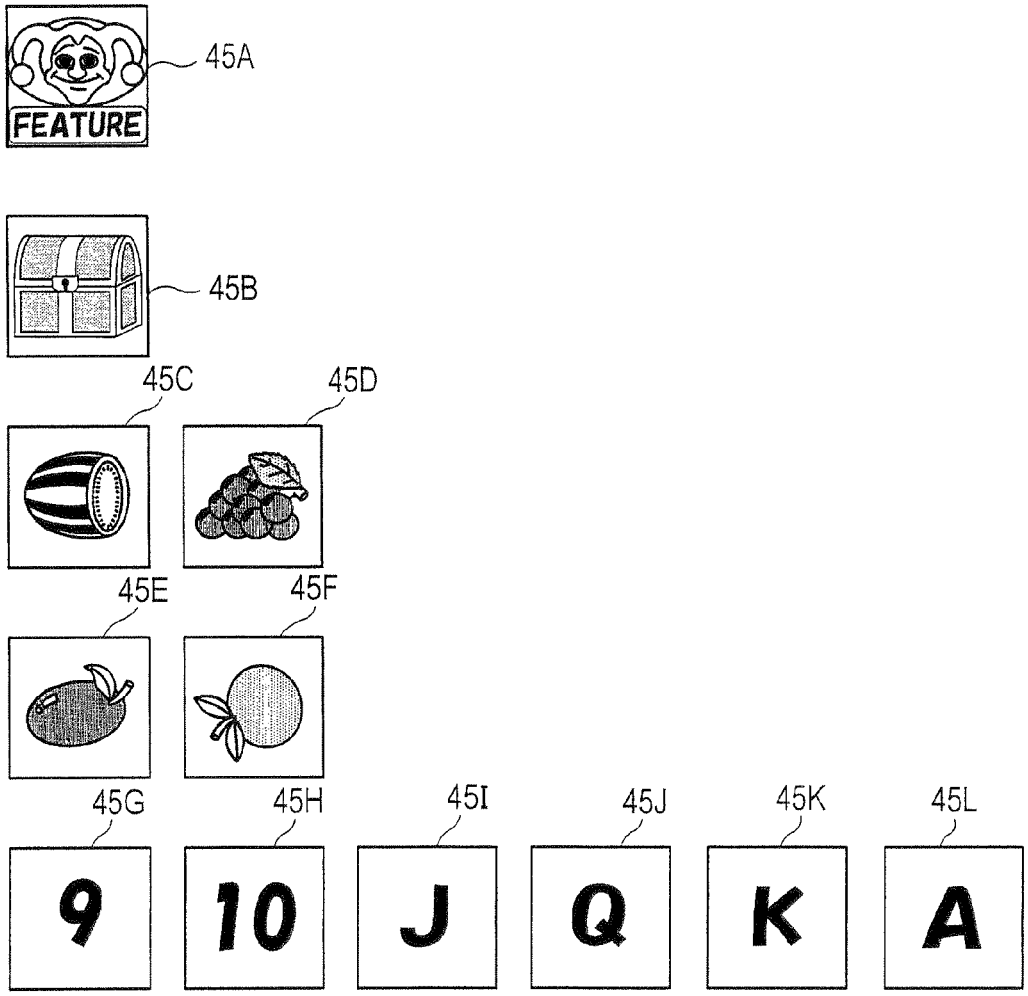
FIG. 7 is an explanatory view illustrating normal symbols constituting each reel of the slot machine.
Figure 9:
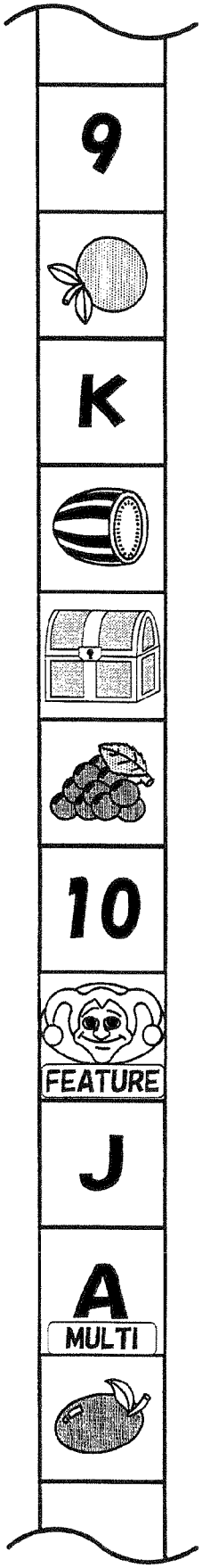
FIG. 9 is an explanatory view illustrating a symbol column constituting each reel of the slot machine.

Next, the symbols which are drawn on the reel bands variably displayed on the reel display portions will be described in detail with reference to the drawings. FIG. 7 is a view showing an example of normal symbols drawn on the reel bands variably displayed on the reel display portions 101 through 105. FIG. 9 is a reel band (outer reel) that is variably displayed on each of the reel display portions.

As shown in FIG. 7 and FIG. 9, a reel band according to the present embodiment includes twelve types of normal symbols. These twelve types of normal symbols consist of a feature symbol 45A (FEATURE), a treasure box symbol 45B (TREASURE), a water melon symbol 45C (WATER MELON), a grape symbol 45D (GRAPE), a plum symbol 45E (PLUM), a orange symbol 45F (ORANGE), a "9" symbol 45G (9), a "10" symbol 45H (10), a Jack symbol 45I (J), a queen symbol 45J (Q), a king symbol 45K (K), and an ace symbol 45L (A).

Further, the reel band according to the present embodiment includes eleven types of multi symbols 50 in addition to the twelve types of normal symbols (refer to FIG. 7). These types of multi symbols consist of a multi treasure box symbol 50B (MULTI-TREASURE), a multi water melon symbol 50C (MULTI-WATER MELON), a multi grape symbol 50D (MULTI-GRAPE), a multi plum symbol 50E (MULTI-PLUM), a multi orange symbol 50F (MULTI-ORANGE), a multi "9" symbol 50G (MULTI-9), a multi "10" symbol 50H (MULTI-10), a multi Jack symbol 50I (MULTI-J), a multi queen symbol 50J (MULTI-Q), a multi king symbol 50K (MULTI-K), and a multi ace symbol 50L (MULTI-A).

Figure 8:
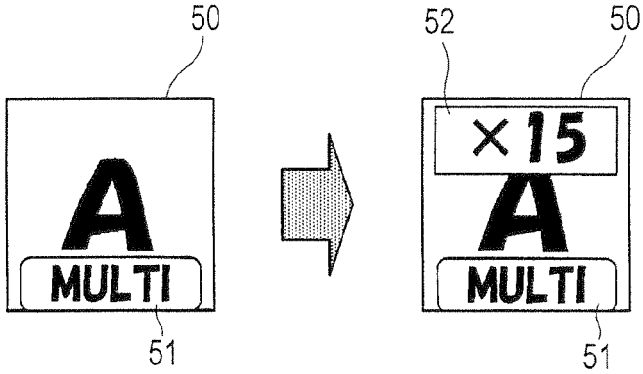
FIG. 8 is an explanatory view with respect to a multi symbol constituting each reel.

As shown in FIG. 8, each of the multi symbols 50 is composed of a figure and a multi notification display 51. The figure included in the multi symbol 50 is the same figure as any one of the treasure box symbol 45B through the ace symbol 45L. The multi notification display 51 consists of a letter string "MULTI".

When the content of the prize is determined, each multi symbol 50 is handled as the same type of symbol as the normal symbol having the same figure included in the multi symbol 50. As described above, in the slot machine 1 according to the present embodiment, a prize that is awarded to the player is determined according to the number of same types of symbols stopped on the variable display portion 3B. Thus, in a case where multi symbols 50 are stopped on the variable display portion 3B, the content of the prize is determined depending on the number of symbols having the same figure (that is, the same types of symbols) irrespective of whether the symbol is normal symbol or multi symbol 50.

As an example, a multi ace symbol 50L shown in FIG. 8 is handled as the same type of symbol as the ace symbol 45L. Accordingly, when three ace symbols 45L and one multi ace symbol 50L are stopped on the variable display portion 3B, the content of the prize is determined to be the content of the prize corresponding to a winning combination related to four ace symbols 45L.

The multi symbol 50 has a function to change the content of the prize to be awarded based on the winning combination (refer to FIG. 12) in a case where the multi symbol 50 is included and a predetermined winning combination (refer to FIG. 12) is achieved. The changed content of the prize is obtained by multiplying the content of the normal prize based on the winning combination by a predetermined bonus ratio. For example, in a case where three ace symbols 45L and one multi ace symbol 50L are stopped on the variable display portion 3B and the bonus ratio is "×15", the content of the prize to be awarded based on the winning combination is equal to a value obtained by multiplying "50 credits" (refer to FIG. 12) by the bonus ratio "×15". The value "50 credits" corresponds to the content of the normal prize according to the winning combination related to the four ace symbols 45L.

As shown in FIG. 8, the multi symbol 50 has two types of display aspects. Two types of display aspect include a first display aspect and a second display aspect. In the special effect process (S17), the multi symbol 50 is changed from the first display aspect to the second display aspect.

The first display aspect only consists of a figure (that is, the same figure as some type of normal symbol) and a multi notification display 51 (refer to the left part of FIG. 8). The second display aspect consists of a bonus ratio display 52 as well as a figure (that is, the same figure as some type of normal symbol) and a multi notification display 51 (refer to the right part of FIG. 8). The bonus ratio display 52 represents the bonus ratio (that is, the bonus ratio to be multiplied by a normal prize based on a winning combination) determined in the special effect process, (S17). Then, the bonus ratio display 52 notifies the bonus ratio determined in the special effect process (S17) to the player.

Then, as shown in FIG. 9, twelve types of normal symbols (refer to FIG. 7) and eleven types of multi symbols 50 (for example, refer to FIG. 8) are drawn on the reel band in a predetermined order. In this case, it should be noted that the reel band shown in FIG. 9 is merely an example. Accordingly, the sequence in which the symbols are drawn may also be determined arbitrarily. The number of symbols drawn on one reel band is determined arbitrarily, and kinds of to-be-drawn symbols may also be defined arbitrarily.

Next, a game executed in the slot machine 1 will be described. All symbols are scatter symbols in the game executed in the slot machine 1. That is, in the game of the present embodiment, a prize is awarded on the basis of the number of same types of the symbols displayed on the symbol display areas 111A through 111C, 112A through 112C, 113A through 113C, 114A through 114C and 115A through 115C of the variable display portion 3B, which are in the form of a 3×5 matrix (refer to FIG. 12).

Figure 10:
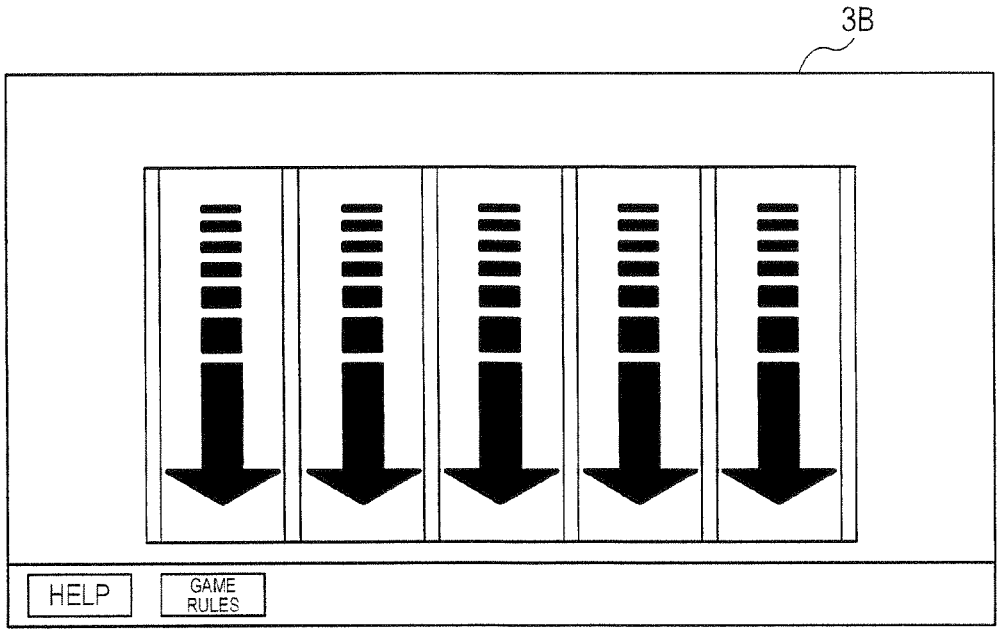
FIG. 10 is an explanatory view illustrating a variable display portion upon variable display of symbols.

In initiating a game in the slot machine 1, a player operates a bet button to set the number of bets. After that, the player presses the start button. As a result, a reel band starts to rotate in each of the reel display portions 101 through 105. That is, in each of the reel display portions 101 through 105, a symbol column drawn on the reel band is scroll-displayed from the upper side to the lower side (refer to FIG. 10).

Figure 11:
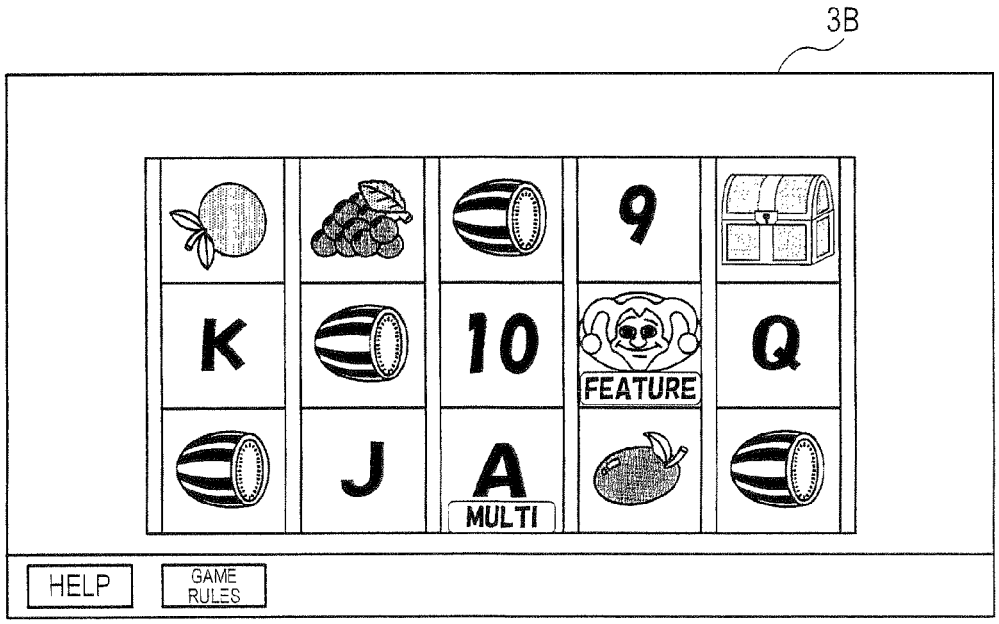
FIG. 11 is an explanatory view illustrating a variable display portion upon stop and display of symbols.

After the lapse of a predetermined time, each reel band is stopped on each reel display portion 101 through 105. Accordingly, a part of the symbol column drawn on each of the reel bands (three symbols of each of the reel bands) is stopped in each of the reel display portions 101 through 105. That is, as shown in FIG. 11, one symbol is stopped respectively in each of the three symbol display areas constituting each reel display portion. Accordingly, fifteen symbols are stopped on the variable display portion 3B (refer to FIG. 11).

As described above, in the game of the present embodiment, a winning combination is determined on the basis of the number of same types of the symbols displayed on the variable display portion 3B. Further, a prize corresponding to the winning combination is awarded. When a player wins a prize corresponding to the winning combination, the amount obtained by multiplying the payout amount corresponding to the winning combination by the number of bets is provided to the player (refer to FIG. 12). This will be described later.

Next, the winning combination and the contents of the prize in the slot machine 1 according to the present embodiment will be described with reference to the drawings. FIG. 12 is a view illustrating a payout table according to the present embodiment.

As shown in FIG. 12, the winning combination and the prize (that is, the payout amount) correspond to each other in the payout table. In this case, the payout amount of the payout table shown in FIG. 12 is the payout amount when the number of bets is "1". That is, when the number of bets is "1", the payout amount shown in FIG. 12 is paid out. When the number of bets is "2" or more, the amount obtained by multiplying the payout amount shown in FIG. 12 by the number of bets is paid out.

For example, when five water melon symbols 45C are displayed on the fifteen symbol display areas (that is, the symbol display areas 111A through 111C, 112A through 112C, 113A through 113C, 114A through 114C and 115A through 115C) in the variable display portion 3B, the "amount obtained by multiplying the number of bets by 200 credits" is paid out to the player (refer to FIG. 12).

Then, when four king symbols 45K are displayed on the fifteen symbol display areas in the variable display portion 3B, the "amount obtained by multiplying the number of bets by 40 credits" is paid out to the player (refer to FIG. 12). A payout amount is set for each winning combination in a similar manner, as shown in FIG. 12.

Then, as described above, in a case where the winning combination shown in FIG. 12 is achieved including a multi symbol 50, the payout amount shown in FIG. 12 is further multiplied by a bonus ratio determined in the special effect process (S17). That is, the prize in this case is calculated as the product of the payout amount shown in FIG. 12, the number of bets, and the bonus ratio. Then, the prize calculated is awarded to the player.

Then, in a case where three or more feature symbols 45A are displayed on the fifteen symbol display areas in the variable display portion 3B, the slot machine 1 provides the player with a bonus game instead of the payout amount. In the present embodiment, a so-called free game is provided to the player as the bonus game.

When the symbols displayed on the fifteen symbol display areas in the variable display portion 3B do not correspond to any winning combination shown in FIG. 12, the game is lost. In this case, the payout amount is not paid out and a prize is not awarded for losing.

Meanwhile, the payout table shown in FIG. 12 is an illustrative example, and the types of the winning combination or the contents of the prize may be set appropriately. For example, the appropriate payout amount may be set as the contents of the prize. Further, bonus games different from the free game (for example, a selective bonus game and the like) or JACKPOT may be provided as the prize in the slot machine 1. Furthermore, a plurality of payout tables may be provided and a payout table may be selected according to a payout rate.

Figure 13:
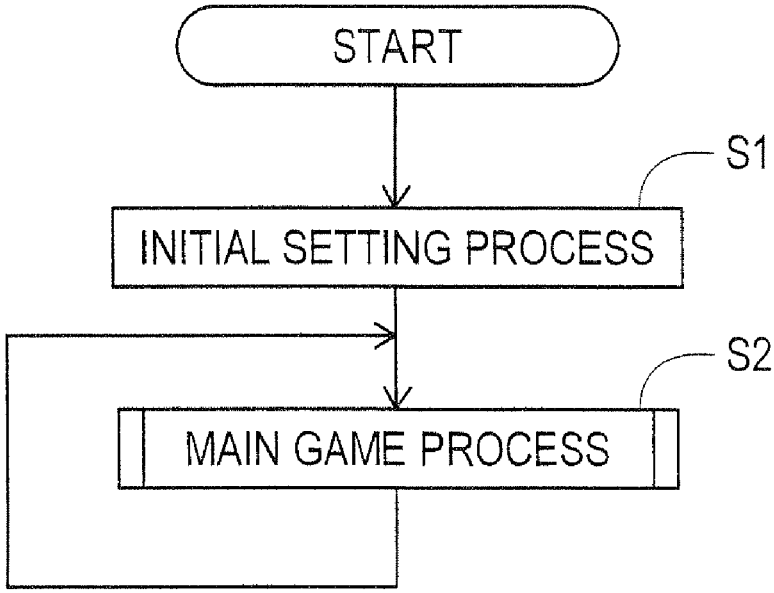
FIG. 13 is a flow chart of a main control process program.

Next, a main control program executed in the slot machine 1 according to the present embodiment will be described in detail with reference to the drawings. FIG. 13 is a flowchart illustrating the main control program.

First, when the power switch is turned on (upon power on), the main control board 71 and the sub control board 72 are activated and the controller 41 executes an initial setting process (S1). In the initial setting process (S1), the main CPU 42 executes the BIOS stored in the ROM 44 and expands the compressed data incorporated in the BIOS in the RAM 43. In executing the BIOS that was expanded in the RAM 43, the main CPU 42 carries out a diagnosis and initialization of the different types of peripheral devices. Further, the main CPU 42 writes the game programs and the like from the ROM 44 into the RAM 43 to acquire payout rate setting data and country identification information. While executing the initial setting process (S1), the main CPU 42 also carries out an authentication process with respect to each program.

When the initial setting process (S1) is terminated, the main CPU 42 executes a main game process (S2). In the main game process (S2), the main CPU 42 sequentially reads out the game program and the like from the RAM 43 and executes the game program. The main game process (S2) is executed, thereby the game is executed in the slot machine 1 according to the present embodiment. Meanwhile, the main game process (S2) is repeatedly executed while power is being supplied to the slot machine 1.

Figure 14:
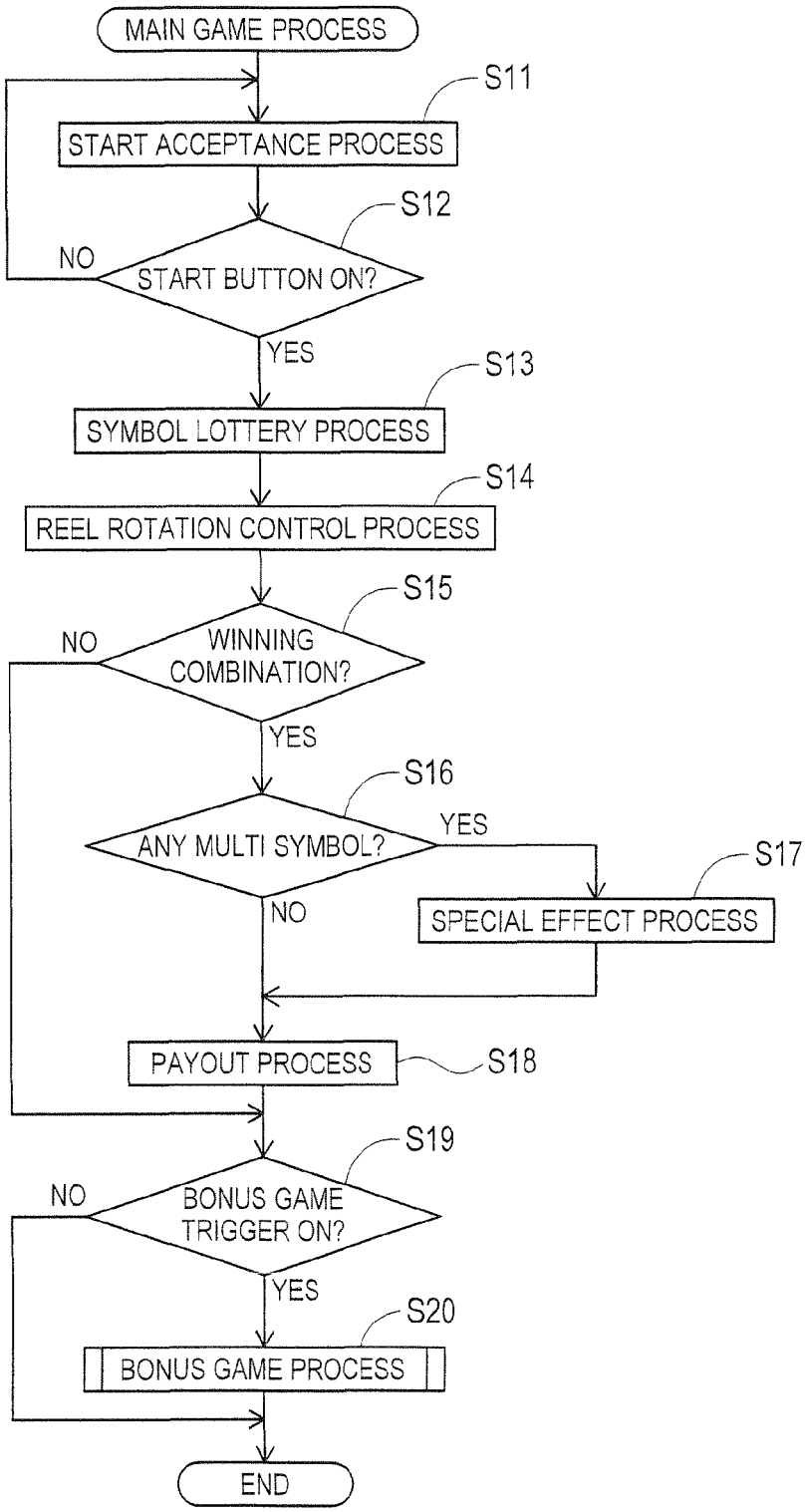
FIG. 14 is a flow chart of a main game process program.

Next, a main game process program executed in the main game process (S2) will be described with reference to the drawings. FIG. 14 is a flowchart illustrating a main game process program of the slot machine 1 according to the present embodiment. Meanwhile, each of the programs illustrated in the following flowchart is stored in the ROM 44 or the RAM 43 that is included in the slot machine 1, and is executed by the main CPU 42.

As shown in FIG. 14, the main CPU 42 executes a start acceptance process (S11). In the start acceptance process (S11), a player inserts coins and executes a betting operation using the bet button of the operation buttons 26.

After shifting to S12, the main CPU 42 judges whether the start button of the operation buttons 26 is pressed or not. The main CPU 42 judges whether the input to the start button exists or not on the basis of whether a signal by the pressing of the start button exists or not. If the start button is pressed (S12: YES), the main CPU 42 subtracts the number of bets that is set based on the betting operation from the credit amount that the player currently possesses. The main CPU 42 stores the subtraction result in the RAM 43 as betting information. If the subtraction from the credit amount and the storing of the betting information are terminated, the main CPU 42 shifts the process to S13. On the other hand, if the start button is not pressed (S12: NO), the main CPU 42 returns the process to the start acceptance process (S11). Accordingly, the player can perform operations, such as correction of the number of bets or the like.

After shifting to S13, the main CPU 42 executes the symbol lottery process. In the symbol lottery process (S13), the main CPU 42 executes the lottery program stored in the RAM 43 in order to sample a random number value from the numerical value range of a predetermined random number value. Further, the main CPU 42 determines the symbols to be stopped on the middle portions of the reel display portions (that is, the symbol display areas 111B, 112B, 113B, 114B, and 115B) based on the sampled random number value and a table.

A process using the random number value in the symbol lottery process (S13) will be described herein with reference to the drawings. FIG. 16 is a view showing an example of a table associating the symbols drawn on one reel band and code numbers. FIG. 16 is a view showing an example of a table associating random number values and code numbers.

In this case, the table associating the symbols and the code numbers (for example, FIG. 15) exists so as to be associated with the each reel display portions 101 through 105.

As described above, in the symbol lottery process (S13), the main CPU 42 executes the lottery program in order to sample a random number value in a predetermined random number range (for example, 0 to 65535). Then, the main CPU 42 determines a code number based on the sampled random number value and the table associating the random number values and the code numbers (for example, refer to FIG. 16). After determining the code number, the main CPU 42 determines a symbol to be stopped on the middle portion of the reel display portion based on the code number and the table where associating the symbols and the code numbers (refer to FIG. 15).

For example, when the reel band shown in FIG. 15 is used for the reel display portion 101 and a random number value "1136" is sampled, the main CPU 42 determines a code number "08" based on the random number value "1136" and the table shown in FIG. 16. Then, the main CPU 42 determines a "10" symbol 45H as a symbol to be stopped on the symbol display area 111B based on the code number "08" and the table shown in FIG. 15.

The process of using random number values in the symbol lottery process S13 is not limited to the present embodiment of using the random number values, the table associating the random number values and the code numbers (for example, refer to FIG. 16), and the table associating the symbols and the code numbers (refer to FIG. 15).

For example, the sampled random number values may be associated directly with the symbols. Further, the sampled random number values may be associated directly with the winning combination, and symbols to be stopped may be determined using the table associating the random number values and the winning combinations. In this case, if a random number value that does not associate with any winning combination is sampled, the game is lost.

The processes in executing the main game process program following the symbol lottery process (S13) will be described herein with reference to FIG. 14.

After the symbol lottery process (S13) is terminated, the main CPU 42 executes the reel rotation control process (S14). In the reel rotation control process (S14), the main CPU 42 variably displays the reel bands on the reel display portions 101 through 105 at a predetermined speed. Then, the main CPU 42 determines an effect pattern (a pattern of the display of an image on the variable display portion 3B, the audio output from the speaker 34, or the like) of a unit game. Further, the main CPU 42 starts the effect based on the effect pattern determined by controlling the sub control board 72, etc. The unit game means a game that is to be executed by a series of processes until all reel bands are stopped from the time when each of the reel bands begins to be variably displayed.

When a predetermined time has elapsed, the main CPU 42 stops the reel bands on the reel display portions 101 through 105 in a predetermined order. Accordingly, one symbol is stopped on each of the fifteen symbol display areas (that is, the symbol display areas 111A through 111C, 112A through 112C, 113A through 113C, 114A through 114C and 115A through 115C) of the variable display portion 3B. Meanwhile, as for the stop of the reel bands on the reel display portions, all reel display portions may be stopped at one time, and may be sequentially stopped with time difference.

The stop of a symbol will be described in detail with reference to the example of the reel display portion 101 that has been described in the symbol lottery process (S13). According to the above-mentioned specific example, the "10" symbol 45H (code number: 8) determined in the symbol lottery process (S13) is stopped on the symbol display area 111B that is a middle portion of the reel display portion 101. In this case, the grape symbol 45D (code number: 7) is stopped on the symbol display area 111A that is an upper portion of the reel display portion 101. Further, the feature symbol 45A (code number: 9) is stopped on the symbol display area 111C that is a lower portion of the reel display portion 101.

After the reel rotation control process (S14), the main CPU 42 judges whether or not the symbols stopped on the variable display portion 3B correspond to the winning combination (S15). More specifically, the main CPU 42 judges whether winning combination is achieved or not based on the code numbers of the reel display portions 101 through 105 stored in the RAM 43.

In a case where a multi symbol 50 is included in the symbols stopped on the variable display portion 3B, the main CPU 42 judges whether or not the symbols correspond to the winning combination while handling the multi symbol 50 (for example, the multi ace symbol 50L) as a normal symbol having the same figure as that of the multi symbol 50 (for example, the ace symbol 45L).

If the winning combination is achieved (S15: YES), the main CPU 42 calculates the payout amount corresponding to the winning combination based on the payout table (refer to FIG. 12). Thereafter, the main CPU 42 shifts the process to S16. On the other hand, if any of the winning combination is not achieved (S15: NO), the main CPU 42 shifts the process to S19. Then, in a case where the subsequent games are continuously initiated, the processes after the process S11 are executed.

After shifting to S16, the main CPU 42 judges whether or not any multi symbol 50 is included in the specific types of symbols corresponding to the winning combination (hereinafter, referred to as "winning symbol group"). If the multi symbol 50 is included in the winning symbol group (S16: YES), the main CPU 42 shifts the process to a special effect process (S17). On the other hand, if the multi symbol 50 is not included in the winning symbol group (S16: NO), the main CPU 42 shifts the process to S18.

Figure 17:
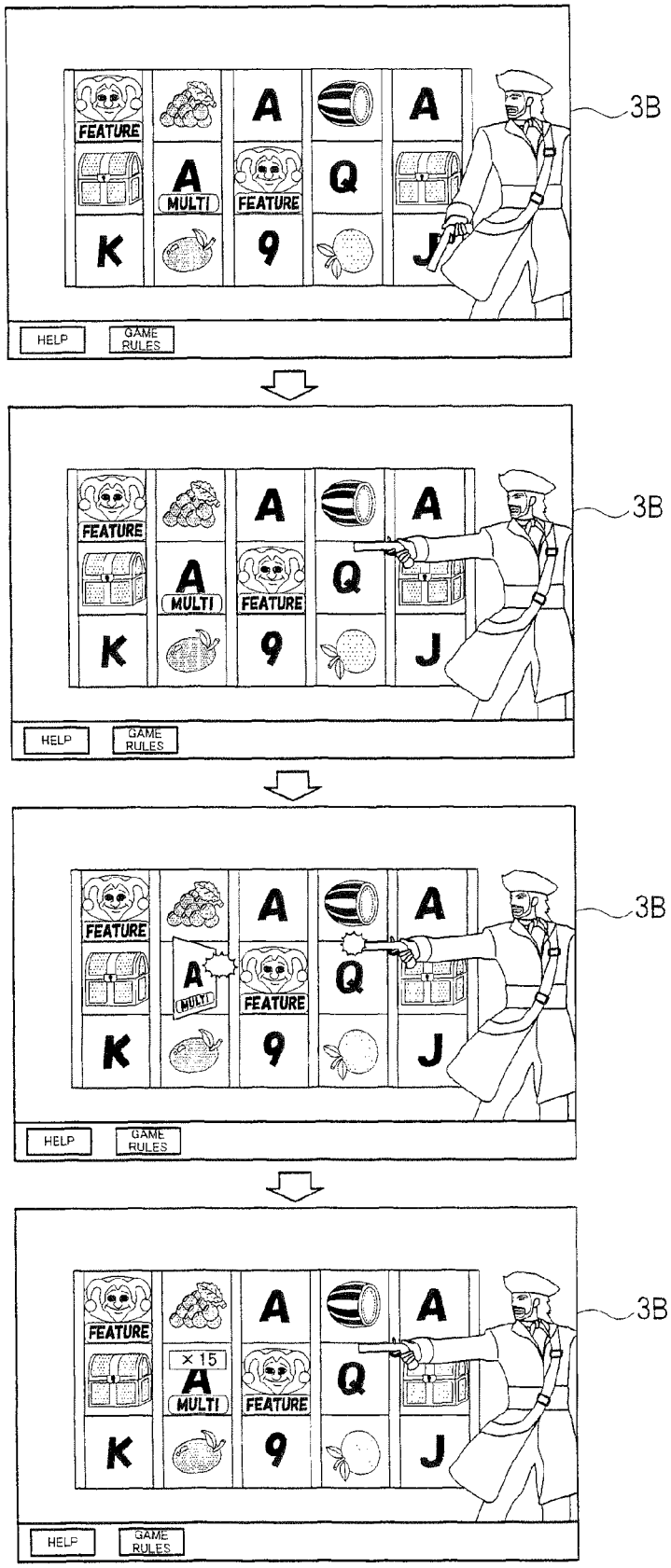
FIG. 17 is an explanatory view with respect to effects displayed on a variable display portion at a special effect process.

In S17, the main CPU 42 executes a special effect process. In the special effect process (S17), the main CPU 42 executes an effect by displaying a character image for an effect (for example, character image of a pirate captain) on the variable display portion 3B (refer to FIG. 17). At this time, the main CPU 42 determines a bonus ratio of the multi symbol 50 stopped on the variable display portion 3B by lottery. Then, upon carrying out the effect in the special effect process (S17), the main CPU 42 changes the display aspect of the multi symbol 50 included in the winning symbol group from the first display aspect to the second display aspect (refer to FIG. 8 and FIG. 17). If the special effect process S17 is terminated, the main CPU 42 shifts the process to S18.

After shifting to S18, the main CPU 42 executes a payout process. In the payout process (S18), the main CPU 42 pays out the payout amount according to the winning combination determined in the process S15 or S17 to the player. After the payout process (S18), the main CPU 42 shifts the process to S19.

In S19, the main CPU 42 judges whether or not a bonus game trigger is achieved. More specifically, the main CPU 42 refers to the code number of each reel display portion 101 to 105 stored in the RAM 43. Then, the main CPU 42 judges "whether or not three or more feature symbols 45A are stopped on the fifteen symbol display areas comprising the variable display portion 3B" based on the code number.

If the bonus game trigger is achieved by the state in which three or more feature symbols 45A are stopped (S19: YES), the main CPU 42 shifts the process to a bonus game process (S20). On the other hand, if the bonus game trigger is not achieved (S19: NO), the main CPU 42 terminates the main game process program. As described above, the main game process program restarts upon termination of it.

As described above, in the present embodiment, the condition for achieving the bonus game trigger is "three or more feature symbols 45A being stopped on the variable display portion 3B". That is, if "three or more" feature symbols 45A are present, the bonus game trigger is achieved. Accordingly, the above condition for achieving the bonus game trigger includes a plurality of conditions, such as a "three or more feature symbols 45A are stopped on the variable display portion 3B", "four or more feature symbols 45A are stopped on the variable display portion 3B", and so on.

After shifting to S20, the main CPU 42 executes a bonus game process. In the bonus game process (S20), the main CPU 42 displays a selection screen on the variable display portion 3B. Thereafter, the main CPU 42 accepts a selection of the player for a game condition choice image 90 displayed. Then, if the selection for the game condition choice image 90 is made by the player, the main CPU 42 executes a free game according to the free game execution condition (that is, the number of free games or a payout rate) associated with the selected game condition choice image 90. After the execution of a predetermined number of free games, the main CPU 42 terminates the bonus game process. Thereafter, the main CPU 42 terminates the main game process program. In this case, the main game process program restarts upon termination of it.

Figure 1:
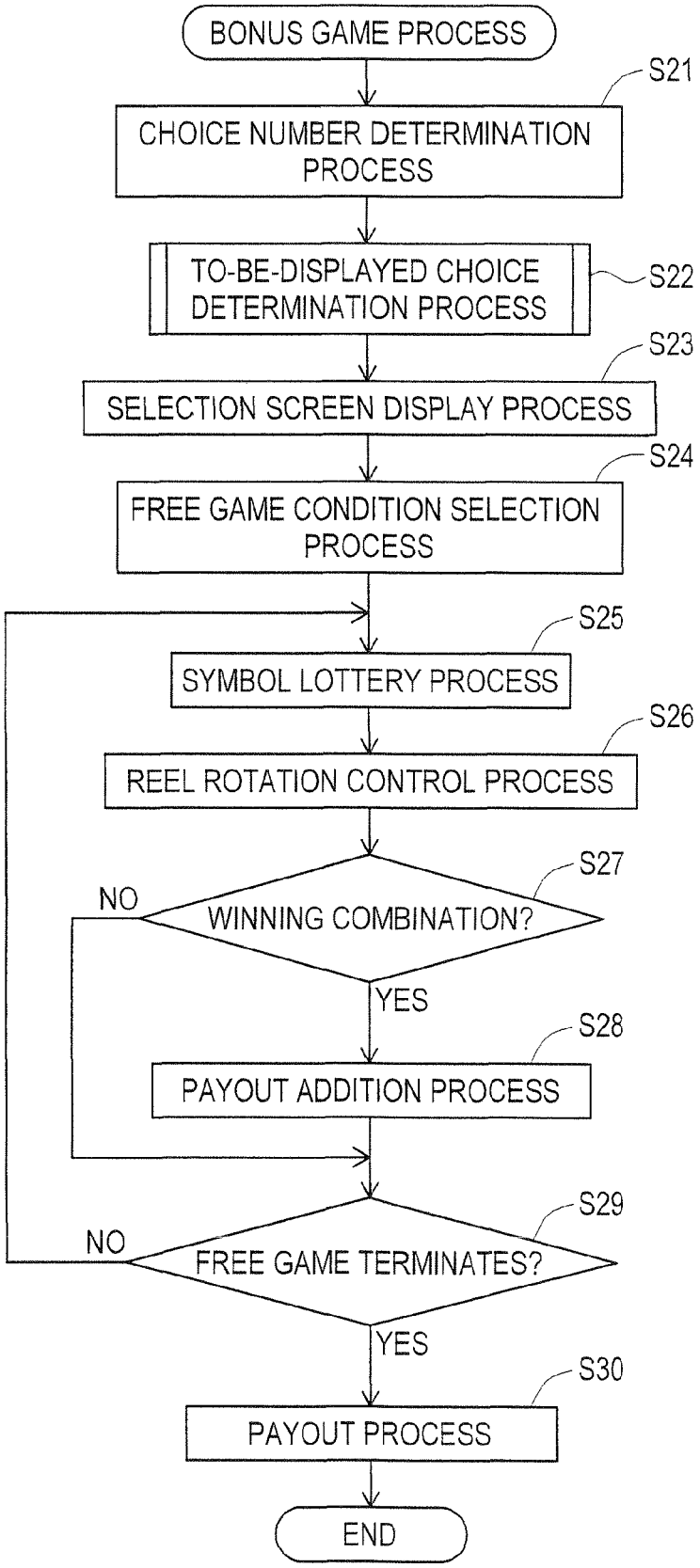
FIG. 1 is a flow chart of a bonus game process program according to the present embodiment.

Next, a bonus game process program executed in the bonus game process (S20) will be described in more detail with reference to accompanying drawings. FIG. 1 is a flowchart illustrating a bonus game process program.

As shown in FIG. 1, starting the execution of the bonus game process program, the main CPU 42 executes a choice number determination process (S21). In the choice number determination process (S21), the main CPU 42 determines the number of game condition choice images 90 displayed on the selection screen (refer to FIGS. 19 through 21). The number of game condition choice images 90 is determined in accordance with the number of the feature symbols 45A stopped on the variable display portion 3B in the reel rotation control process (S14). That is, in the choice number determination process (S21), the main CPU 42 determines the number of conditions selectable by the player upon execution of the free game.

The choice number determination process (S21) will be described more specifically. The main CPU 42 identifies the number of feature symbols 45A stopped on the variable display portion 3B based on the code number of each reel display portion or the like stored in the RAM 43. Then, the main CPU 42 determines the number of game condition choice images 90 to be displayed on the selection screen (hereinafter, referred to as "number of choices") based on the number of identified feature symbols 45A and the choice number determination table. The main CPU 42 stores the determined number of choices in the RAM 43 and shifts the process to S22.

Here, the choice number determination table used in the choice number determination process (S21) will be described with reference to FIG. 18. As described above, in the present embodiment, in a case where three or more feature symbols 45A are stopped on the variable display portion 3B, the main CPU 42 shifts the process to the bonus game process (S20). Accordingly, it is assumed that there are present three or more feature symbols 45A stopped on the variable display portion 3B. In the choice number determination table, the number (that is, more than three) of feature symbols 45A stopped on the variable display portion 3B is classified into three phases. The choice number determination table is configured in three phases each associated with the number of game condition choice images 90 to be displayed on the selection screen (that is, the number of choices). Accordingly, the main CPU 42 can determine the number of choices corresponding to the stopped feature symbols 45A by specifying the number of stopped feature symbols 45A and referring to the choice number determination table shown in FIG. 18.

After shifting to S22, the main CPU 42 executes a to-be-displayed choice determination process. In the to-be-displayed choice determination process (S22), the main CPU 42 determines the to-be-displayed choices from the plurality of game condition choice images 90 (twenty four types in the present embodiment) associated with a free game execution condition respectively. At this time, the main CPU 42 determines the to-be-displayed choices by specifying the number determined in the choice number determination process (S21) of the game condition choice images 90 by lottery. After the determination of the to-be-displayed choices by lottery, the main CPU 42 stores the determined to-be-displayed choices in the RAM 43. Then, the main CPU 42 shifts the process to S23. The to-be-displayed choice determination process (S22) will be described later in more detail with reference to accompanying drawings.

Here, in the present embodiment, there exist twenty four types of game condition choice images 90 as described above (refer to FIG. 23). Each of the twenty four types of game condition choice images 90 is associated with one "number of free games" respectively. The "number of free games" related to the present embodiment includes "the number of free games: 2" through "the number of free games: 25". The free game execution condition associated with the game condition choice image 90 contains a payout rate according to the number of free games. The payout rate is set low in a case where the number of free games is large. Then, the payout rate is set high in a case where the number of free games is small. Accordingly, no matter which game condition choice image 90 is selected, the expectation value in the free game substantially becomes constant.

In the present embodiment, the "to-be-displayed choice" means the game condition choice image 90 to be displayed on the selection screen, and this is an object to be displayed on the selection screen. In other words, the "to-be-displayed choice" is a game condition choice image 90 that may be subjected to a selection to be made by a player upon the initiation of the bonus game.

In the process (S23), the main CPU 42 executes a selection screen display process. In the selection screen display process (S23), the main CPU 42 displays a selection screen together with the game condition choice images 90 determined in the choice number determination process (S21) and the to-be-displayed choice determination process (S22). After displaying the selection screen on the variable display portion 3B, the main CPU 42 shifts the process to a free game condition selection process (S24).

Hereinafter, the selection screen displayed on the variable display portion 3B in the selection screen display process (S23) will be described in more detail with reference to accompanying drawings.

Firstly, the selection screen to be displayed in a case where three feature symbols 45A are stopped on the variable display portion 3B when the reel rotation control process (S13) is terminated will be described. In this case, three feature symbols 45A are stopped, and therefore, the main CPU 42 executes the bonus game process (S20). Then, the main CPU 42 determines the number of choices displayed on the selection screen related to the free game as "the number of choices: 8" in the choice number determination process (S21). The "number of choices: 8" corresponds to three feature symbols 45A (refer to FIG. 18). Accordingly, as shown in FIG. 19, eight game condition choice images 90 are displayed on the selection screen in this case. As a result, the player can select one game condition choice image 90 from the eight game condition choice images 90. That is, the player can select his desired one condition from the eight types of free game execution conditions.

Figure 20:
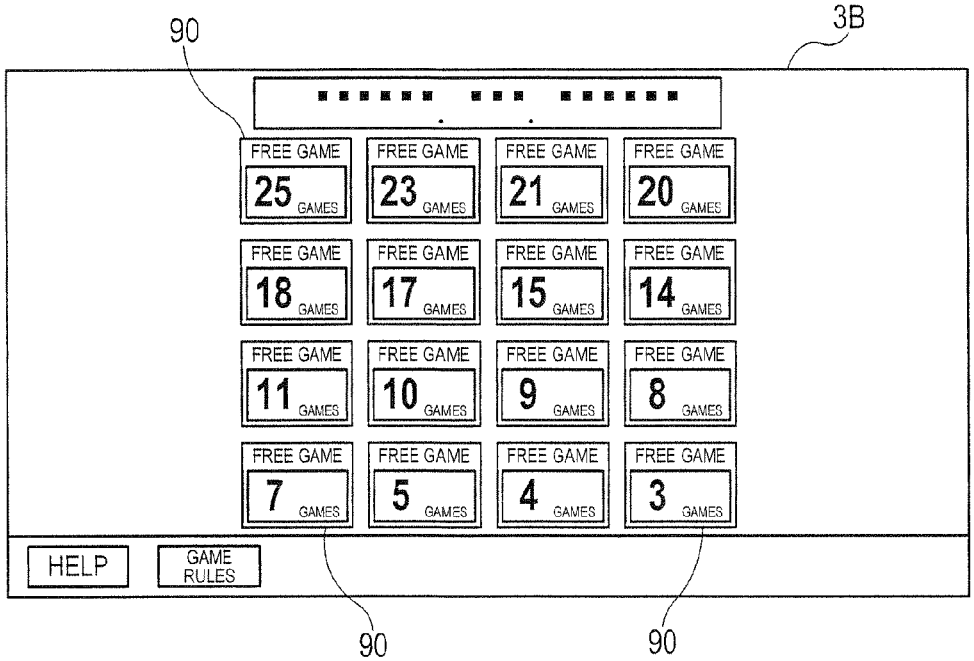
FIG. 20 is an explanatory view illustrating an example of a choice screen displayed when the number of choices is 16.

Next, the selection screen displayed on the variable display portion 3B in a case where four through six feature symbols 45A are stopped on the variable display portion 3B when the reel rotation control process (S13) is terminated will be described. In this case, four through six feature symbols 45A are stopped (S19: YES), and therefore, the main CPU 42 executes the bonus game process (S20) like the example described with reference to FIG. 19. In the choice number determination process (S21), the main CPU 42 determines the number of choices displayed on the selection screen related to the free game as "the number of choices: 16". "The number of choices: 16" corresponds to four through six feature symbols 45A (refer to FIG. 18). Accordingly, as shown in FIG. 20, sixteen game condition choice images 90 are displayed on the selection screen in this case. As a result, the player can select one game condition choice image 90 from the sixteen game condition choice images 90. That is, the player can select his desired one condition from the sixteen types of free game execution conditions. As a consequence, in case of the selection screen shown in FIG. 20, the player can select a desired condition from more types of free game execution conditions than in case of the selection screen shown in FIG. 19. Accordingly, the player may enjoy "a high degree of freedom in selecting the game execution conditions".

Figure 21:
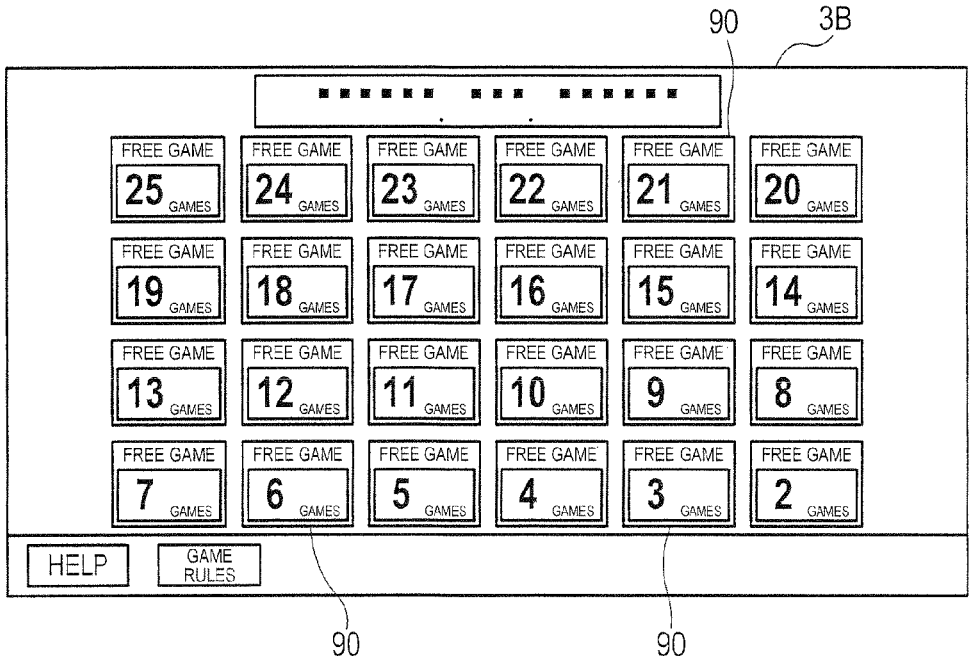
FIG. 21 is an explanatory view illustrating an example of a choice screen displayed when the number of choices is 24.

Subsequently, the selection screen displayed on the variable display portion 3B in a case where six or more feature symbols 45A are stopped on the variable display portion 3B when the reel rotation control process (S13) is terminated will be described. In this case, six or more feature symbols 45A are stopped (S19: YES), and therefore, the main CPU 42 executes the bonus game process (S20) like the examples described with reference to FIG. 19 and FIG. 20. In the choice number determination process (S21), the main CPU 42 determines the number of choices displayed on the selection screen related to the free game as "the number of choices: 24". The "the number of choices: 24" corresponds to six or more feature symbols 45A (refer to FIG. 18). Accordingly, as shown in FIG. 21, twenty four game condition choice images 90 are displayed on the selection screen in this case. As a result, the player can select one game condition choice image 90 from the twenty four game condition choice images. That is, the player can select one desired condition from the twenty four types of free game execution conditions. As a consequence, in case of the selection screen shown in FIG. 21, the player can select a desired condition from more types of free game execution conditions than in case of the selection screen shown in FIG. 19 and FIG. 20. Accordingly, the player can enjoy a high degree of freedom in selecting the game execution conditions.

In S24, the main CPU 42 executes a free game condition selection process (S24). In the free game condition selection process (S24), the main CPU 42 accepts a selection operation of the player for the game condition choice images 90 displayed on the selection screen. The selection operation of the player is performed by pressing a part of the touch panel 4 corresponding to the game condition choice image 90 displayed on the selection screen. Accordingly, the main CPU 42 identifies the game condition choice image 90 selected by the player based on an input signal from the touch panel 4. The main CPU 42 stores data related to the game condition choice image 90 selected by the player (hereinafter, referred to as "execution condition data") in the RAM 43. Then, the main CPU 42 terminates the free game condition selection process (S24). After that, the main CPU 42 shifts the process to S25.

In S25, the main CPU 42 executes a symbol lottery process. After that, the main CPU 42 executes a reel rotation control process (S26). The symbol lottery process (S25) and the reel rotation control process (S26) are equal to the symbol lottery process (S13) and the reel rotation control process (S14) in the main game process program, respectively. The symbol lottery process (S13) and the reel rotation control process (S14) have been already described above, and thus, further descriptions on the symbol lottery process (S25) and the reel rotation control process (S26) will be omitted. After the reel rotation control process (S26) is terminated, the main CPU 42 shifts the process to S27.

After shifting to S27, the main CPU 42 judges whether or not the symbols stopped on the variable display portion 3B correspond to any winning combination. The process in S27 is identical to the process in S15 in the main game process program. Thus, further descriptions on the process in S27 will be omitted. If the winning combination is achieved (S27: YES), the main CPU 42 shifts the process to S28. On the other hand, if the winning combination is not achieved (S27: NO), the main CPU 42 shifts the process to S29.

In S28, the main CPU 42 executes a payout addition process. In the payout addition process (S28), the main CPU 42 sequentially adds the payout amount determined in S27 to the payout amount obtained during the bonus game process. The payout amount added in the payout addition process (S28) will be paid out to the player in a payout process (S30) to be described later.

In S29, the main CPU 42 adds "1" to the value of the free game number counter formed in the RAM 43. Thereafter, the main CPU 42 judges whether or not the free game meets its termination condition. That is, the main CPU 42 reads out the number of free games from the RAM 43. The number of free games is contained in the execution condition data stored in the free game condition selection process (S24). Then, the main CPU 42 compares the number of free games with the free game number counter value. Then, the main CPU 42 judges whether or not the games of the number that corresponds to the number of free games related to the execution condition data have been executed.

If games have been executed a certain number of times equivalent to the number of free games directed to the execution condition data (S29: YES), the main CPU 42 shifts the process to a payout process (S30). That is, the games of a certain number of times equivalent to the number of free games directed to the execution condition data are executed in the slot machine 1. On the other hand, if games have not been executed a certain number of times equivalent to the number of free games directed to the execution condition data (S29: NO), the main CPU 42 returns the process to the symbol lottery process (S21). As a result, the slot machine 1 executes a free game again.

As described above, the execution condition data is the data based on the free game execution condition associated with the game condition choice image 90 selected by the player in the free game condition selection process (S24). Then, the game condition choice image 90 is selected by the player from the game condition choice images 90 displayed on the selection screen (refer to FIG. 19 through FIG. 21). Accordingly, the slot machine 1 executes the free game according to the desired condition related to the game condition choice image 90.

After shifting to S30, the main CPU 42 pays out to the player the payout amount added in the payout addition process (S28). In addition, in the payout process (S28), the payout amount has been collectively paid out at one time when a predetermined number of the free games are terminated. However, the payout amount may be paid out in each of the free games.

Figure 22:
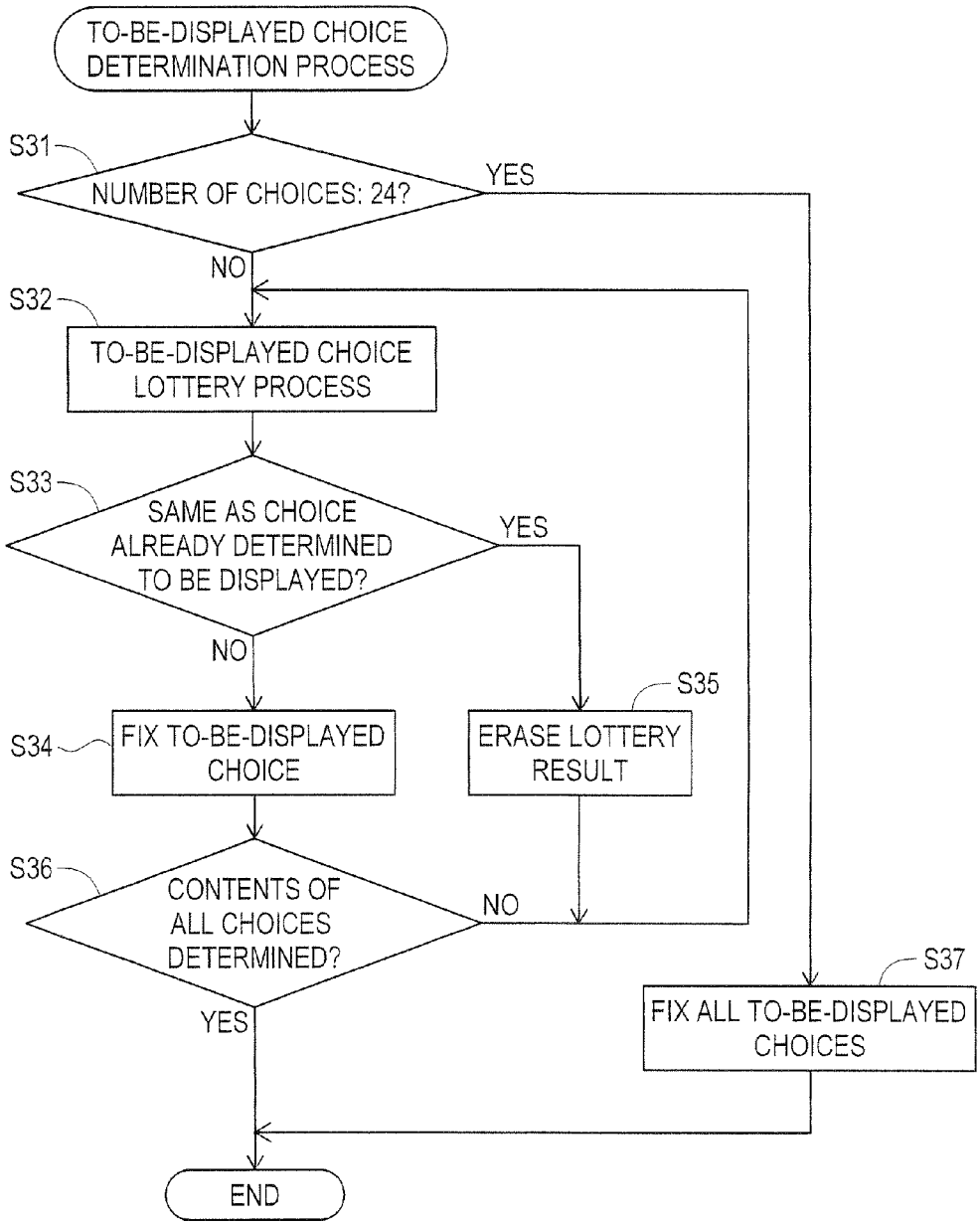
FIG. 22 is a flow chart of a to-be-displayed choice determination program.

Next, the to-be-displayed choice determination process program executed in the bonus game process program (S22) will be described in more detail with reference to accompanying drawings. FIG. 22 is a flowchart illustrating the to-be-displayed choice determination process program.

As shown in FIG. 22, starting the execution of the to-be-displayed choice determination process program, the main CPU 42 determines whether or not the number of choices determined in the choice number determination process (S21) is "24" by referring to the RAM 43. If the number of choices is "24" (S31: YES), the main CPU 42 shifts the process to S37. If the number of choices is not "24" (S31: NO), the main CPU 42 shifts the process to S32.

In S32 which the process shifts in a case where the number of choices is "8" or "16" (S31: NO), the main CPU 42 executes a to-be-displayed choice lottery process. In the to-be-displayed choice lottery process (S32), the main CPU 42 samples one random number value from a predetermined range of random number values. Then, the main CPU 42 extracts a game condition choice image 90 based on the sampled random number value and the to-be-displayed choice lottery table shown in FIG. 23. The main CPU 42 stores lottery result data in the RAM 43. This lottery result data shows the extracted game condition choice image 90. Then, the main CPU 42 shifts the process to S33.

Hereinafter, the to-be-displayed choice lottery table will be described with reference to accompanying drawings. As described above, there exist twenty four types of game condition choice images 90 (that is, the choices that may be the to-be-displayed choices). In the present embodiment, there are twenty four types of the game condition choice images 90 (that is, choices that may be the to-be-displayed choices) each of which associated with one "number of the free games" respectively. The "number of free games" related to the present embodiment includes "the number of free games: 2" through "the number of free games: 25". As shown in FIG. 23, the to-be-displayed choice lottery table related to the present embodiment includes the twenty four types of game condition choice images 90 (that is, choices that may be the to-be-displayed choices). In the to-be-displayed choice lottery table, each of the twenty four types of game condition choice images 90 is associated with a predetermined range of random number values respectively. Accordingly, the main CPU 42 can extract one game condition choice image 90 by sampling one random number value.

After shifting to S33, the main CPU 42 judges whether or not the game condition choice image 90 extracted in the to-be-displayed choice lottery process (S32) is the same as the game condition choice image 90 that has been already extracted. That is, the main CPU 42 executes the judgment process in S33 by comparing the lottery result data stored in the RAM 43 with fixed choice data. Here, the fixed choice data indicates a game condition choice image 90 that is completely determined to be a to-be-displayed choice. If the game condition choice image 90 shown in the lottery result data is the same as the game condition choice image 90 related to the fixed choice data (S33: NO), the main CPU 42 shifts the process to S34. On the other hand, if the game condition choice image 90 shown in the lottery result data is not the same as the game condition choice image 90 related to the fixed choice data (S33: YES), the main CPU 42 shifts the process to S35.

After shifting to S34, the main CPU 42 changes the lottery result data into the fixed choice data. After that, the main CPU 42 stores the fixed choice data changed in the RAM 43. As a result, the game condition choice image 90 extracted in the to-be-displayed choice lottery process (S32) is fixed as the game condition choice image 90 to be displayed on the selection screen. Thereafter, the main CPU 42 shifts the process to S36.

On the other hand, in S35, the main CPU 42 erases the lottery result data from the RAM 43. That is, in this case, the lottery result data does not become the fixed choice data. After having erased the lottery result data from the RAM 43, the main CPU 42 returns the process to S32. As a result, the main CPU 42 executes the to-be-displayed choice lottery process (S32) again. That is, the main CPU 42 newly extracts one game condition choice image 90 from the twenty four types of game condition choice images 90.

Here, the process in S35 is executed in a case where the game condition choice image 90 shown in the lottery result data is the same as the fixed choice data stored in the RAM 43 (S33: YES). That is, any fixed choice data shown in the same game condition choice image 90 is not stored in the RAM 43.

In the selection screen display process (S23), the main CPU 42 displays the game condition choice image 90 based on the fixed choice data stored in the RAM 43. Accordingly, any game condition choice images 90 associated with the same free game execution condition is not displayed on the selection screen (refer to FIGS. 19 through 21). As a result, the game condition choice images 90 (that is, free game execution conditions) displayed on the selection screen are different from each other. Thus, the slot machine 1 can sufficiently secure a wide range of selection for the free game execution conditions.

In S36, the main CPU 42 determines whether or not the fixed choice data of the number which corresponds to the number of choices are stored in the RAM 43. As described above, the number of choices is determined in the choice number determination process (S21). More specifically, the main CPU 42 executes the judgment process in S36 by comparing the number of choices with the number of fixed choice data stored in the RAM 43. If the fixed choice data of the number that corresponds to the number of choices are stored in the RAM 43 (S36: YES), the main CPU 42 terminates the to-be-displayed choice determination process program. On the other hand, if the fixed choice data of the number that corresponds to the number of choices are not stored in the RAM 43 (S36: NO), the main CPU 42 returns the process to S32.

On the other hand, in S37 which is executed in a case where "the number of choices" is 24 (S31: YES), the main CPU 42 stores fixed choice data showing all of the twenty four types of game condition choice images 90 in the RAM 43. After storing the fixed choice data related to the overall twenty four types of game condition choice images 90 in the RAM 43, the main CPU 42 terminates the to-be-displayed choice determination process program. Here, in a case where the process S37 is executed, the number of types of the game condition choice images 90 (that is, twenty four types) is identical to "the number of choices: 24". Accordingly, even though the whole types of game condition choice images 90 are selected as the to-be-displayed choices, the main CPU 42 can determine the to-be-displayed choices corresponding to the number of choices without having the same game condition choice images 90. As a result, the slot machine 1 can abbreviate some processes such as the to-be-displayed choice lottery process (processes S32 through S36). That is, the slot machine 1 can alleviate the processing load accompanied with the to-be-displayed choice determination process (S21) in this case.

As such, the main CPU 42 determines the game condition choice images 90 of the number that corresponds to the number of choices determined in the choice number determination process (S21) by executing the to-be-displayed choice determination process program. At this time, the main CPU 42 determines the game condition choice images 90 from the twenty four types of game condition choice images 90 by lottery. As a result, the slot machine 1 displays the game condition choice images 90 that are randomly determined on the selection screen. That is, the slot machine 1 can diversify the free game execution conditions selectable by a player. Accordingly, the slot machine 1 can provide the player with free games under a diversity of conditions. In addition, the slot machine 1 can prevent the free games from being monotonous.

Furthermore, the slot machine 1 according to the present embodiment executes the processes S32 through S36. Herewith, any game condition choice image 90 associated with the same free game execution condition is not displayed on the selection screen. That is, the plural game condition choice images 90 displayed on the selection screen indicate different free game execution conditions respectively. That is to say, no game condition choice image 90 shows the same contents with others. Consequently, the slot machine 1 can secure a sufficient degree of freedom in selection in a range corresponding to the number of choices.

As described above, the slot machine 1 according to the present embodiment variably displays and stops the twenty three types of symbols (normal symbols and multi symbols). Then, the slot machine 1 awards a player a prize corresponding to the number of symbols of the same type that are stopped on the variable display portion 3B. Then, in a case where three or more feature symbols 45A are stopped on the variable display portion 3B (S19: YES), the slot machine 1 provides the player with a free game as a bonus game (S20).

In the bonus game process S20, before the beginning of the free game (S23), the slot machine 1 displays a selection screen (refer to FIG. 19 through FIG. 21) on the variable display portion 3B. If the player selects one of plural game condition choice images 90 displayed on the selection screen (S24), the slot machine 1 executes the free game according to the condition related to the selected game condition choice image 90 (S25 through S30).

Figures 18, 19:
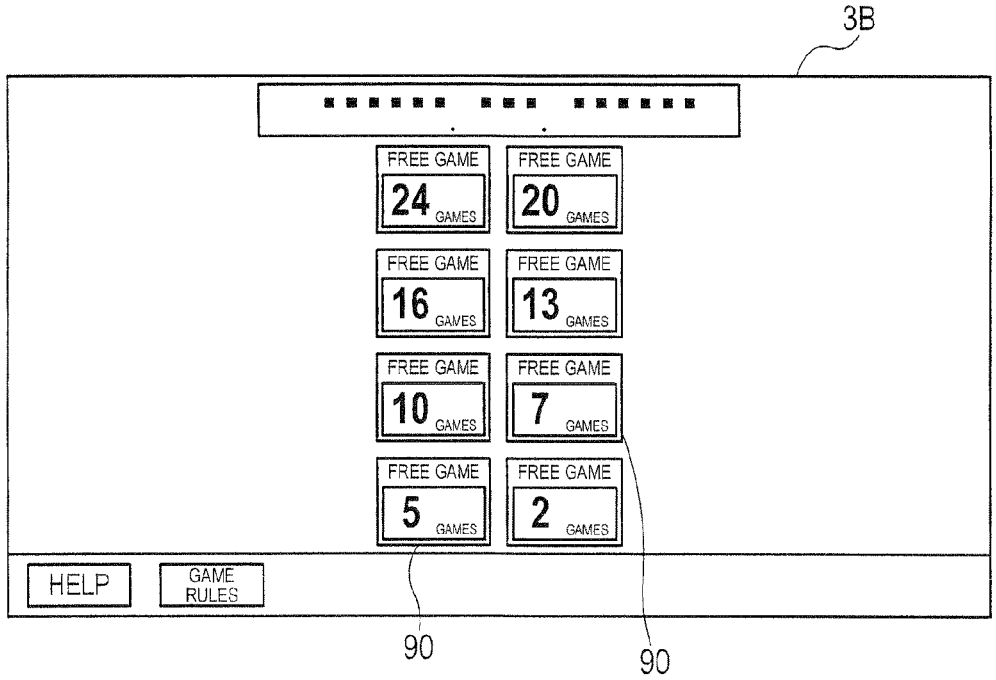
FIG. 18 is an explanatory view of a choice number determination table.
FIG. 19 is an explanatory view illustrating an example of a choice screen displayed when the number of choices is 8.

Here, in a case where three or more feature symbols 45A are stopped on the variable display portion 3B, the slot machine 1 according to the present embodiment changes the number of game condition choice images 90 to be displayed on the selection screen (refer to FIG. 19 through FIG. 21). At this time, the slot machine 1 changes the number of game condition choice images 90 based on the number of feature symbols 45A stopped on the variable display portion 3B (S21 through S23). As a result, the number of game condition choice images 90 selectable by a player (that is, degree of freedom in free game execution condition) is changed. Accordingly, the slot machine 1 can alleviate a feeling of inequity between players.

Furthermore, the slot machine 1 according to the present embodiment executes a free game according to the game condition choice image 90 selected by a player (that is, selected free game execution condition) in the selection screen. That is, the slot machine 1 executes the free game based on the execution condition selected by the player himself/herself. As a result, the slot machine 1 can raise interest in the free game without damaging a feeling of expectancy of the player about the free game. Then, the player arbitrarily selects one game condition choice image 90 from the plural game condition choice images 90 displayed on the selection screen. Accordingly, the slot machine 1 can provide the player with the interest based on "the strategy properties concerning the selection of the game condition choice image 90".

In addition, the slot machine 1 according to the present embodiment determines the game condition choice image 90 to be displayed on the selection screen by lottery in the to-be-displayed choice determination process (S22). Herewith, the slot machine 1 can diversify the free game execution conditions selectable by a player. Accordingly, the slot machine 1 can provide the player with free games under a diversity of conditions. As a consequence, the slot machine 1 can prevent the free game from being monotonous.

It should be noted that the present invention is not limited to the present embodiment, and rather its various modifications and variations may be made without departing from the spirits of the present invention. For example, in the choice number determination table according to the present embodiment (refer to FIG. 18), the number of stopped feature symbols 45A falls into one of three phases (that is, "three", "four through six" and "six or more"). Each of the three phases is associated with the number of choices (that is, "the number of choices: 8", "the number of choices: 16" and "the number of choices: 24") respectively. However, the present invention is not limited to such an aspect. That is, any other aspects may be employed, if the conditions of shifting to the bonus game fall into at least two or more phases. For example, it may be also possible that the number of stopped feature symbols 45A falls into phases, such as "three stopped feature symbols" and "four stopped feature symbols", each of which corresponds to a different number of choices.

Then, it has been described that the slot machine 1 according to the present embodiment provides a player with a "free game" as a bonus game. The present invention is not limited to such an aspect. That is, the present invention may apply to various bonus games, such as a selective bonus game. For example, in case of a selective bonus game, it is possible to make the execution conditions for the selective bonus game correspond to the game condition choice image 90. In this case, the number of selections of the selective bonus game or payout rate may be employed as the execution conditions of the selective bonus game.

Then, in the to-be-displayed choice determination process (S22) according to the present embodiment, one game condition choice image 90 is extracted by lottery from twenty four types of game condition choice images 90. Then, the game condition choice images 90 of the number that corresponds to the number of choices, which are displayed on the selection screen, are determined. However, the present invention is not limited to this aspect. That is, any other methods may be employed as long as the game condition choice images 90 of the number that corresponds to the number of choices displayed on the selection screen may be determined by lottery. For example, an aspect may be employed where the plurality of display patterns which specify the game condition choice images 90 of the number that corresponds to the number of choices are provided. In this case, the game condition choice images 90 of the number that corresponds to the number of choices to be displayed on the selection screen are determined by determining one of the display patterns by lottery.

In the to-be-displayed choice lottery process (S32) related to the present embodiment, the to-be-displayed choice lottery table shown in FIG. 23 is always used to execute the process. However, the present invention is not limited to such an aspect. For example, whenever one game condition choice image 90 is fixed as a to-be-displayed choice, the to-be-displayed choice lottery table may be replaced with another to-be-displayed choice lottery table in which the number of game condition choice images 90 that are subjected to lottery has been decreased. Then, the to-be-displayed choice lottery process (S32) may be executed by using the replaced to-be-displayed choice lottery table.

More specifically, whenever the main CPU 42 fixes the one extracted game condition choice image 90 as a to-be-displayed choice, the main CPU 42 generates a to-be-displayed choice lottery table from which the game condition choice image 90 has been excluded. That is, the main CPU 42 generates a to-be-displayed choice lottery table by allocating a range of random number values to each of the other game condition choice images 90 than the fixed game condition choice image 90. After that, the main CPU 42 executes the to-be-displayed choice lottery process (S32) using the generated to-be-displayed choice lottery table (that is, the to-be-displayed choice lottery table in which twenty three or less game condition choice images 90 are subjected to lottery).

This configuration may remove likelihood where the same game condition choice image 90 is repetitively extracted in the to-be-displayed choice lottery process (S32). Accordingly, in this case, the slot machine 1 may execute the to-be-displayed choice determination process (S21) without executing the processes S33 and S35. In this case, the slot machine 1 may alleviate the processing load associated with the to-be-displayed choice determination process (S21).

Further, in the present embodiment the variable display portion 3B is configured as a liquid crystal panel, but the variable display portion 3B may be also configured as a mechanical reel and a transparent liquid crystal display device arranged on the front of the mechanical reel. That is, the slot machine 1 may be configured as a so-called hybrid type gaming machine. In this case, the figure drawn on the mechanical reel may be viewed through the transparent liquid crystal display device. In addition, in case of the hybrid type gaming machine, it deems desirable to provide the transparent liquid crystal display device with display windows of the number that corresponds to the number the mechanical reels, so that the figures drawn on the mechanical reels may be viewed through the display windows. In case of using the mechanical reels, the rotation and stop of the mechanical reels are controlled by motors (not shown).

In addition, the present invention may be also implemented as a game method for executing the above processes. Then, the present invention may be also implemented as a program for executing the game method through a computer and a recording medium storing the program.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A gaming machine comprising:

a display on which plural types of symbols are variably displayed and stopped; and a processor for executing, (a) a process of executing a base game, wherein the symbols start to be variably displayed on the display and the symbols are stopped while the symbols are variably displayed on the display;

(b) a process of awarding a prize for the base game based on a combination of the symbols stopped on the display;

(c) a process of determining to-be-displayed number of choice images that are selectable by a player and displayed on the display, the choice images each being associated with free game condition including number of free games and payout rate in the free games according to a corresponding type of a special combination, in a case where the combination of the symbols stopped on the display corresponds to one of plural types of special combinations; and (d) a process of displaying the to-be-displayed number of the choice images determined at the process (c) on the display, accepting a selection of the player for the choice images, and executing the free game according to the free game condition related to the choice image selected by the player;

wherein the free game condition is set such that payout rate in the free game is set lower as the number of free games is larger, and payout rate in the free game is set higher as the number of free games is smaller.

2. The gaming machine according to claim 1, wherein the free game condition is set such that an expectation value in free game becomes constant regardless of difference in the number of free games.

3. A gaming machine comprising:

a display on which plural types of symbols are variably displayed and stopped; and a processor for executing, (a) a process of executing a base game, wherein the symbols start to be variably displayed on the display and the symbols are stopped while the symbols are variably displayed on the display;

(b) a process of awarding a prize for the base game based on a combination of the symbols stopped on the display;

(c) a process of determining to-be-displayed number of choice images that are selectable by a player and displayed on the display, the choice images each being associated with free game condition including number of free games according to a type of a special combination, in a case where the combination of the symbols stopped on the display corresponds to one of plural types of special combinations; and (d) a process of displaying the to-be-displayed number of the choice images determined at the process (c) on the display in a state that free game condition of each choice image is disclosed, accepting a selection of the player for the choice images, and executing a free game according to the free game condition related to the choice image selected by the player.

4. The gaming machine according to claim 3, wherein the free game condition is set such that an expectation value in free game becomes constant regardless of difference in the number of free games.

* * * * *